US011845000B1

(12) United States Patent
Curley

(10) Patent No.: US 11,845,000 B1
(45) Date of Patent: Dec. 19, 2023

(54) CARD HANDLING APPARATUS FOR SUSTAINING CASINO PLAY RATE

(71) Applicant: Charles M. Curley, Cortland, NY (US)

(72) Inventor: Charles M. Curley, Cortland, NY (US)

( * ) Notice: Subject to any disclaimer, the term of this patent is extended or adjusted under 35 U.S.C. 154(b) by 0 days.

(21) Appl. No.: 18/446,108

(22) Filed: Aug. 8, 2023

(51) Int. Cl.
*A63F 1/12* (2006.01)
*A63F 1/00* (2006.01)

(52) U.S. Cl.
CPC ..... *A63F 1/12* (2013.01); *A63F 2001/003* (2013.01); *A63F 2250/58* (2013.01)

(58) Field of Classification Search
CPC ... A63F 1/12; A63F 2001/003; A63F 2250/58
USPC ..... 273/149 R
See application file for complete search history.

(56) References Cited

U.S. PATENT DOCUMENTS 4,586,712 A 5/1986 Lorber
5,669,816 A 9/1997 Garczynski
5,683,085 A 11/1997 Johnson
5,718,427 A 2/1998 Cranford
5,722,893 A 3/1998 Hill
5,944,310 A 8/1999 Johnson
5,989,122 A 11/1999 Roblejo
6,126,166 A 10/2000 Lorson
6,250,632 B1 6/2001 Albrecht
6,254,096 B1 7/2001 Grauzer
6,361,044 B1 3/2002 Block
6,403,908 B2 6/2002 Stardust
6,651,982 B2 4/2003 Grauzer
6,629,894 B1 10/2003 Purton
6,638,161 B2 10/2003 Soltys
6,651,981 B2 * 11/2003 Grauzer ..... A63F 1/12 273/149 P
6,676,127 B2 1/2004 Johnson
6,726,205 B1 4/2004 Purton
6,889,979 B2 5/2005 Blaha
7,036,818 B2 5/2006 Grauzer
7,367,561 B2 5/2008 Blaha
7,523,935 B2 4/2009 Grauzer
7,584,962 B2 9/2009 Breeding
7,677,565 B2 3/2010 Grauzer
7,753,373 B2 * 7/2010 Grauzer ..... A63F 1/18 273/293
7,764,836 B2 7/2010 Downs
7,766,333 B1 8/2010 Stardust
7,784,790 B2 8/2010 Grauzer
8,011,661 B2 9/2011 Stasson
8,038,521 B2 10/2011 Grauzer
(Continued)

*Primary Examiner* — Allen Chan
(74) *Attorney, Agent, or Firm* — Chris Tanner; Jared Doster; BlueCollarIP.com

(57) ABSTRACT

An automatic card handling apparatus for use in casino card games possesses a card deck intake portal and a card deck discharge portal which are both accessible by a dealer. The apparatus allows two fully-shuffled, but separated, card decks to be ready for play simultaneously. A first shuffled card deck is independently supported in the card deck discharge portal by a retractable support structure while a second shuffled card deck remains ready for play while independently supported by a slot-less elevator within the footprint of the first shuffled deck. Three separated decks can be automatically routed through the apparatus in order to sustain uninterrupted card play. Also disclosed is a method of randomizing a group of playing cards.

22 Claims, 21 Drawing Sheets

(56) References Cited

U.S. PATENT DOCUMENTS

| | | | | |
|---|---|---|---|---|
| 8,485,527 | B2 | 1/2013 | Grauzer | |
| 8,366,109 | B2 | 2/2013 | Soltys | |
| 8,381,918 | B2 | 2/2013 | Johnson | |
| 8,419,521 | B2 | 4/2013 | Grauzer | |
| 8,444,147 | B2 | 5/2013 | Grauzer | |
| 8,556,263 | B2 | 10/2013 | Grauzer | |
| 8,579,289 | B2 * | 11/2013 | Rynda | A63F 1/12 273/149 R |
| 8,646,779 | B2 | 2/2014 | Grauzer | |
| 8,807,348 | B2 | 8/2014 | Johnson | |
| 8,814,164 | B2 | 8/2014 | Baker | |
| 8,899,587 | B2 | 12/2014 | Grauzer | |
| 8,960,674 | B2 * | 2/2015 | Stasson | H05K 999/00 273/149 P |
| 9,138,635 | B1 | 9/2015 | Sines | |
| 9,457,262 | B2 | 10/2016 | Shigeta | |
| 9,504,905 | B2 | 11/2016 | Kelly | |
| 9,975,041 | B2 | 5/2018 | Gingher | |
| 10,022,617 | B2 | 7/2018 | Stasson | |
| 10,092,819 | B2 | 10/2018 | Haushalter | |
| 10,238,954 | B2 | 3/2019 | Stasson | |
| 10,532,272 | B2 | 1/2020 | Bourbour | |
| 10,668,361 | B2 | 6/2020 | Stasson | |
| 10,960,292 | B2 | 3/2021 | Stasson | |
| 11,173,383 | B2 | 11/2021 | Krenn | |
| 11,338,194 | B2 | 5/2022 | Helgesen | |
| 11,367,489 | B2 | 6/2022 | Tokutomi et al. | |
| 11,426,649 | B2 | 8/2022 | Rynda | |
| 2007/0238502 | A1 | 10/2007 | Pokorny | |
| 2015/0238848 | A1 * | 8/2015 | Kuhn | A63F 1/12 273/149 R |
| 2020/0171375 | A1 | 6/2020 | Litman | |

* cited by examiner (1997)

(1997)

(2003)

(2003)

FIG. 12B
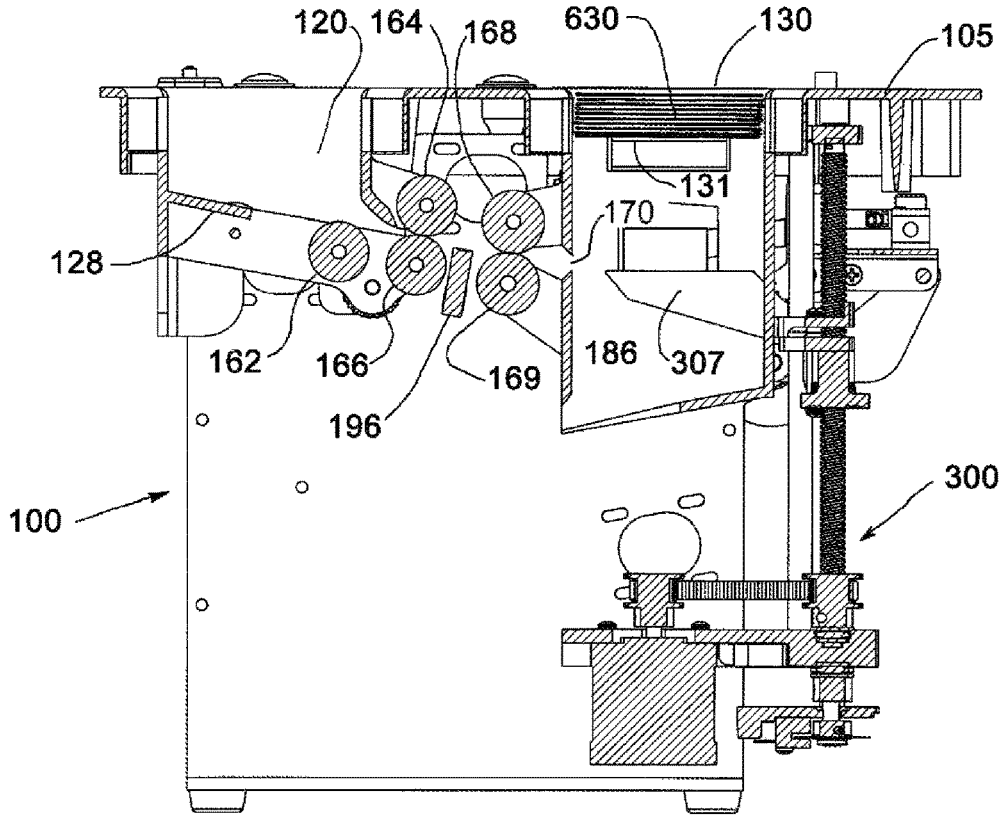
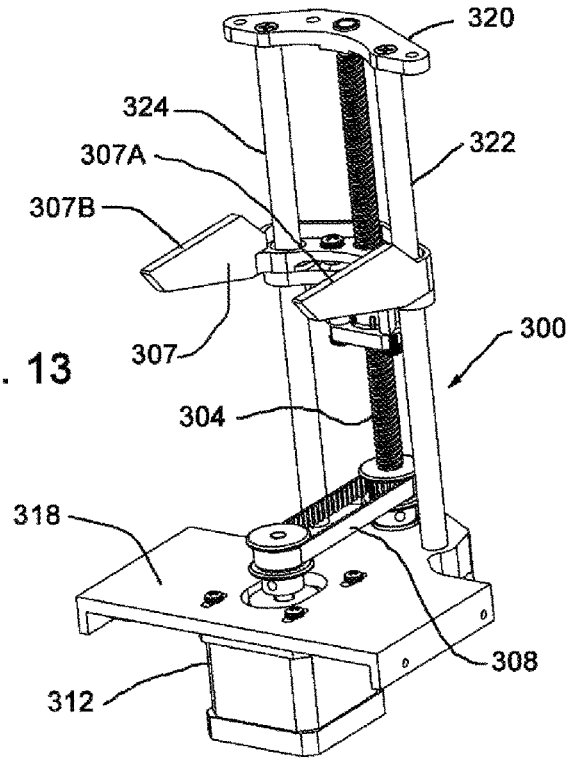
FIG. 13

FIG. 14
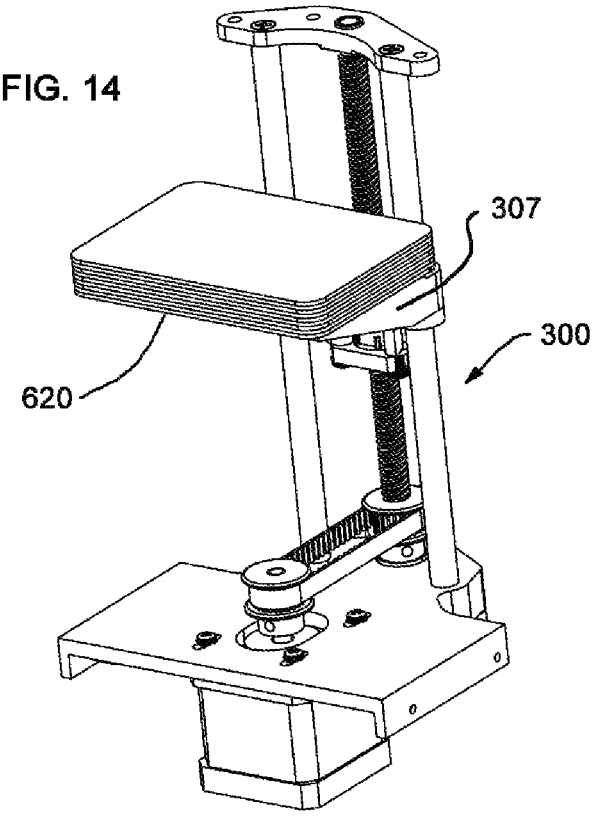
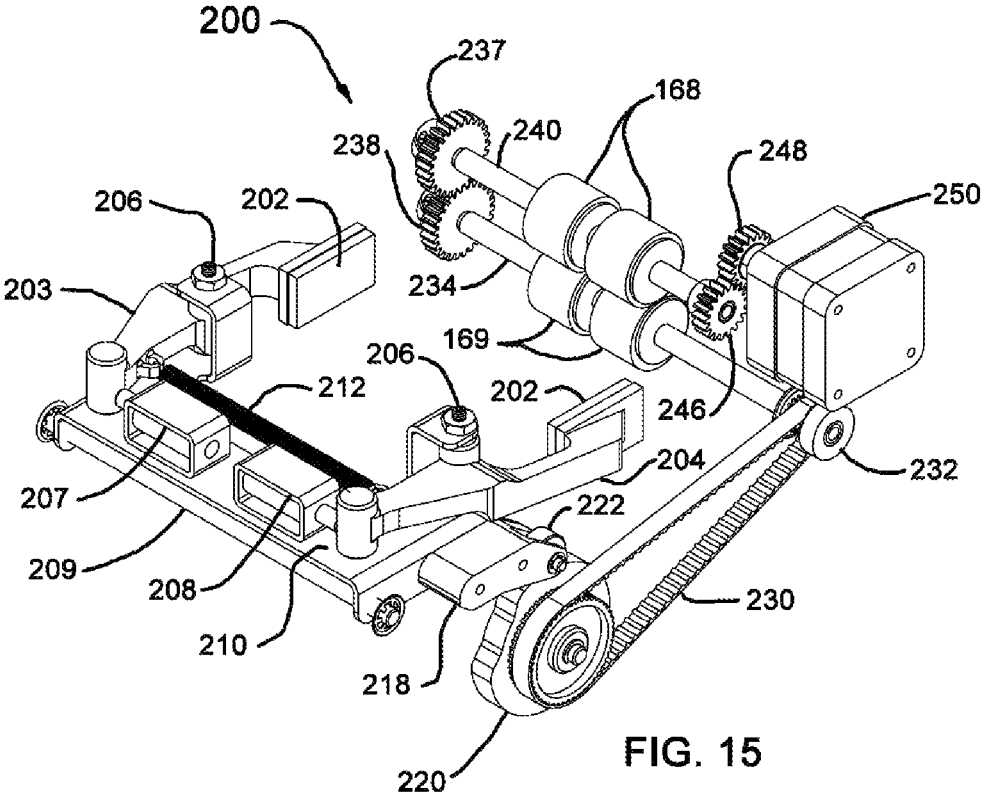
FIG. 15

FIG. 16
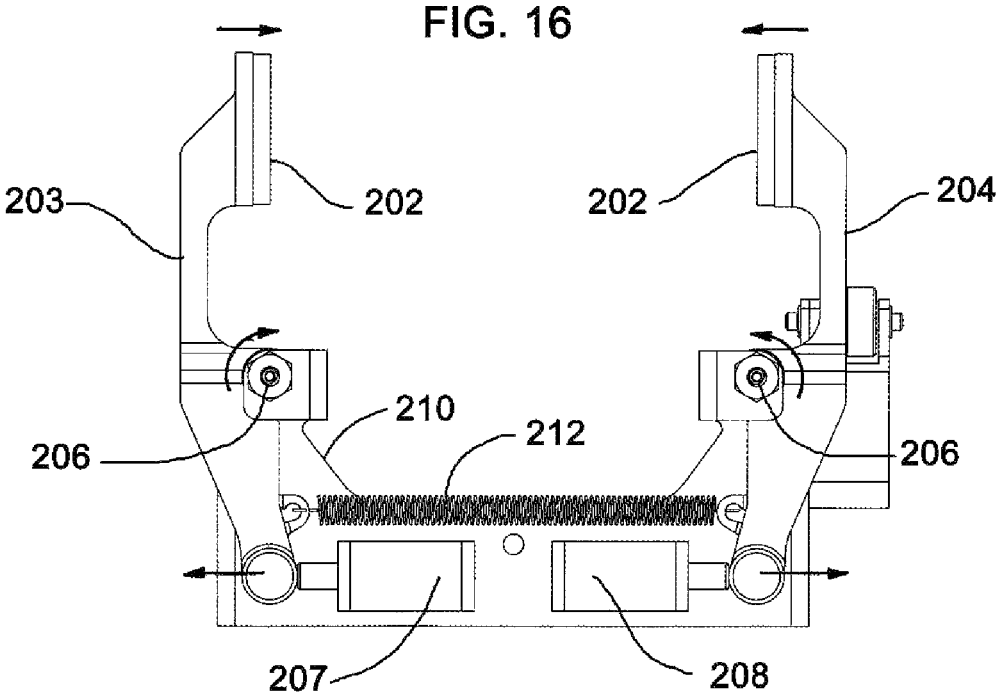
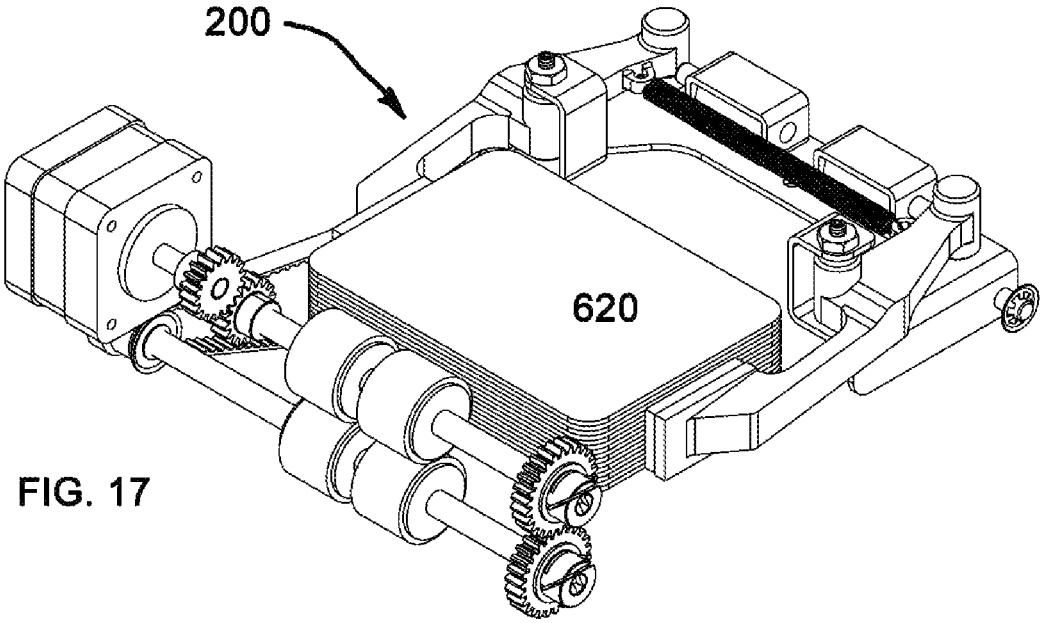
FIG. 17

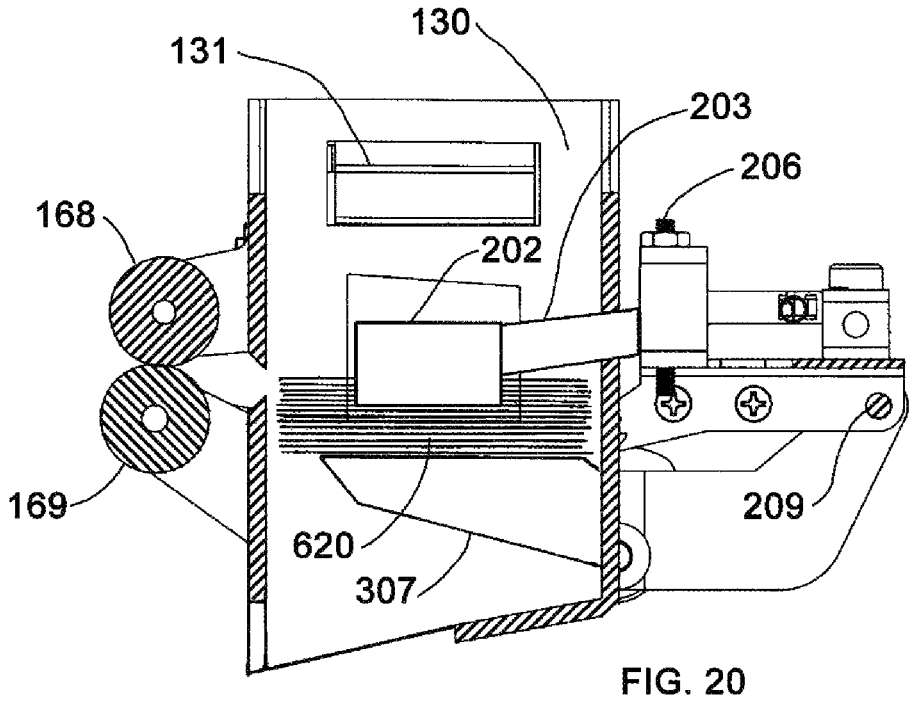
FIG. 20
FIG. 21
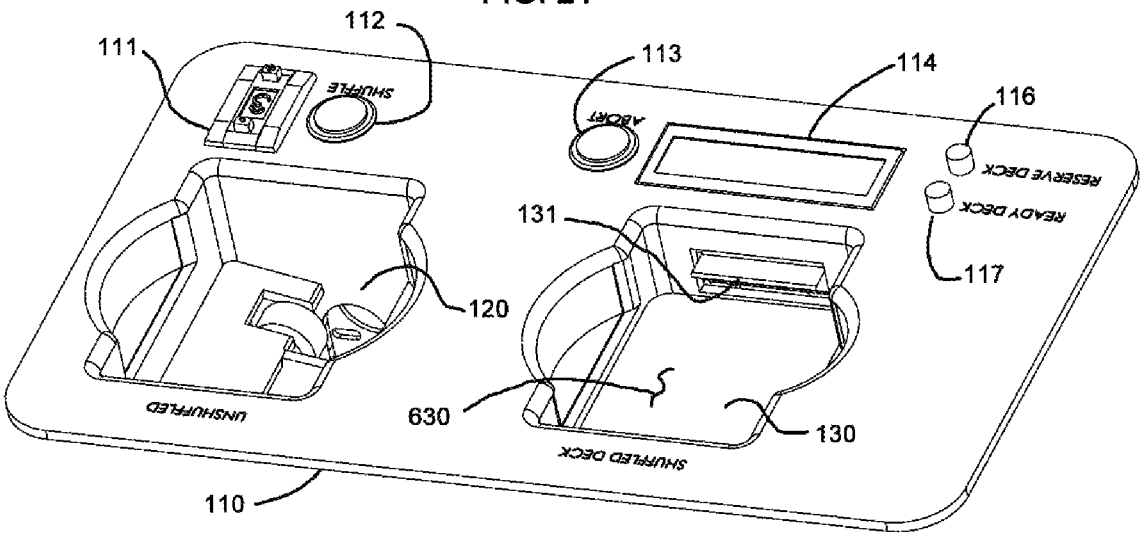

EXAMPLE:
D = 4, P = RAND [ 1 TO D ]

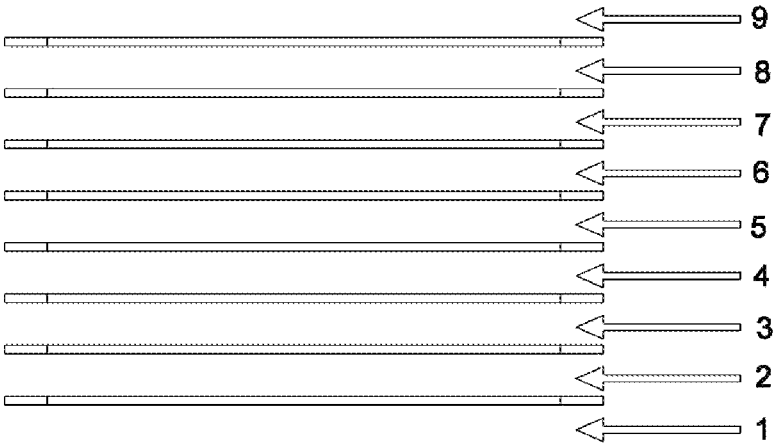
EXAMPLE:
D = 9, P = RAND [ 1 TO D ]
FIG. 29B
FIG. 30
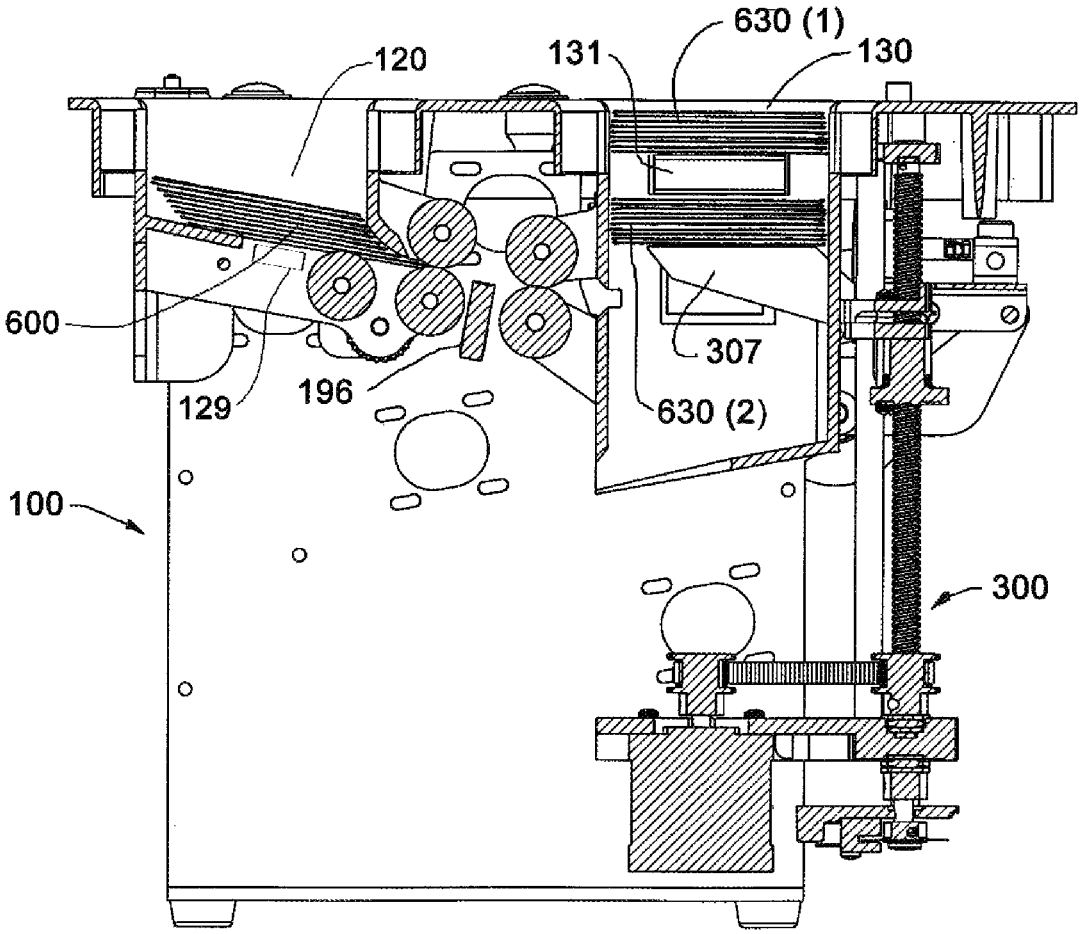

CARD HANDLING APPARATUS FOR SUSTAINING CASINO PLAY RATE

FIELD OF INVENTION

The present invention is related to the field of electromechanical shuffling machines, which are used by casinos to speed up the rate of play of dealer-hosted card games. More particularly, the invention relates to shuffling machines which randomize the rank and suit of cards within a single deck of playing cards, as for example for use in a game of single-deck Blackjack where a dealer issues playing cards to players from a single pre-shuffled deck of 52 cards.

BACKGROUND

Card games such as Blackjack are major attractions in casinos because they are relatively easy to play and allow wagering to various degrees of risk. A single deck of 52 playing cards are often used in these games, which must be periodically shuffled to effect randomness of the rank and suit of the individual cards within the deck. It is to the advantage of the casino to reduce the time that a dealer handles and shuffles playing cards between games, thereby increasing revenues. Casinos thus use automatic shuffling machines to speed up the rate of play at gaming tables, retaining the interest of the players and sustaining the rate of play.

Shuffling machines are relatively slow devices because they must handle each and every card in the deck, both to randomly rearrange its deck position and to verify its proper authenticity and existence. One way to sustain rate of table play in a casino is for the dealer to utilize a "two-deck rotation". Shuffling machines which facilitate the "two-deck rotation" usually possess an unshuffled card intake portal and a shuffled card discharge portal. Such a prior art example is shown in FIG. 1 as taught by U.S. Pat. No. 6,651,982 (Grauzer), where the recess 2026 is a card receiving area for receiving unshuffled cards, and the recess 2032 is a shuffled card return area. The unshuffled cards are released into the mechanism below the recess 2026 where they are randomly rearranged and thereafter raised to the recess 2032 by elevator surface 2014. Shuffling of another unshuffled deck is able to commence only after the newly-shuffled deck is removed from the elevator surface 2014 by the dealer. US'982 discloses in column 9 that a shuffling apparatus 2020 has a card accepting receiving area 2026 that has a lower support surface that slopes downwardly from the nearest outer side 2029 of the shuffling apparatus 2024. The card return area 2032 possess an elevator surface 2014 and two card supporting sides 2034.

While the shuffling machine is shuffling the previously "played" deck, the dealer uses a newly-shuffled deck to execute the game with the players. When that deck is reasonably depleted, the dealer can then return that deck to the shuffling machine and fetch a newly-shuffled deck from that machine, such that there is relatively little interruption in play. While the game is being played with one deck, a newly-shuffled deck is being made ready within the automatic shuffler. However, the newly shuffled deck may be faulty and unfit for play, causing the dealer to delay the game until another deck is shuffled.

The prior art explains that automatic shuffling machines have traditionally utilized verification measures to ensure the integrity of the deck by sensing and tracking the rank and suit of every card within the deck during the shuffling process. Numerous prior art references teach optical recognition devices to verify that the deck is complete and does not contain extraneous cards. Automatic shuffling machines verify that each and every card of each suit is included as required by the game being played, and that there exists no missing or extraneous cards resulting from machine malfunction or cheating.

For example, prior art U.S. Pat. No. 5,989,122 (Roblejo) as reproduced in FIG. 2 discloses an automatic shuffler that utilizes an optical card reader 2044 which reads rank and suit of individual cards before they are moved from an unshuffled input stack 2042 to the randomizing mechanism. The role of the optical recognition device is to verify the composition and completeness of a set of playing cards prior to randomizing. US'122 explains that an apparatus 2040 has a control means 2041, an input means for receiving playing cards onto an input stack holder 2042, and buffer means having a plurality of slots for temporarily holding cards, illustrated as a wheel 2043 having a plurality of slots 2048. The apparatus additionally possesses identification means for reading indicia, illustrated as bar code reader 2044 to determine identity of playing cards which can be specially marked with bar codes or other coded information. Alternatively, the cards can be unmarked.

US'122 states:

> "It is an object of this invention to provide an apparatus and method for receiving cards, either from new decks or after the cards have been played, to shuffle the cards in a randomized order, and simultaneously to verify the accuracy of the set or sets of cards in the deck or decks. (US'122 col. 2; lines 22-27)
>
> "The means for reading indicia is preferably either a bar code reader, Video optical System, optical Scanner, reader of hologram information, or reader of magnetic indicia. (US'122, col. 3; lines 65-67)"

US'122 also disclosed the use of the apparatus as a card deck verification apparatus, independent of its functions as a card shuffler:

> "In another aspect, the invention comprises a process comprising providing such an apparatus, feeding to the input means one or more cards either after they have been played in a game or from an unrandomized or unverified set, and manually retrieving a verified true set of cards from the stacking means." (US'122, col. 2; lines 53-58)

An excerpted illustration from prior art U.S. Pat. No. 6,629,894 (Dolphin Advanced Technologies) is shown in FIG. 3 and discloses alternative configurations of a digital camera (commonly known as a CMOS camera) arranged to inspect rank and suit of each card as a machine passes each card from one stack to another. Cards from a card stack 2000 on platform 2001 are fed from the bottom of the stack via a drive roller 2002 to pinch rollers 2007, which facilitate movement to card stack 2005. In one embodiment the cards of card stack 2000 are face down and a first camera 2003 reads the face of the cards within the card stack 2000 via a window 2004 of the platform 2001. A second digital camera 2006 can be mounted below the pinch rollers 2007 such that a face of the card can be read between the card stacks 2000 and 2005. In another embodiment, the camera 2006 is above the pinch rollers 2007 to read any cards that are face up between card stacks 2000 and 2005.

US'894 states:

> "The camera reads the face of the cards and using on board image processing, provides a data output which includes the suit and value portion of the face of the card. (US'894 col. 5; lines 67, col. 6; lines 1-3)

"[A] a card stack may be supported by a platform through which a drive roller extends. This allows cards to be fed from the bottom of the stack. In this embodiment, the cards are placed face down. So that each card may be read by an upward looking digital camera, the platform is provided with a window or opening. In the alternative, the cards may be read between stacks, by a digital camera mounted above (with the cards face up) or below the pinch rollers (with the cards face down) which facilitate card transport between the two stacks." (US'894 col. 4; lines 60-67, col. 5; lines 1-3)

Prior art U.S. Pat. No. 6,638,161 (Soltys) discloses the use of a CMOS color sensor which is utilized for verifying individual cards within a deck. The sensor explained in that disclosure is a Model PB300 made by Photobit, which captures a 640×480 pixel color image of the indicia on playing cards, including the rank and suit. Prior art U.S. Pat. No. 5,669,816 (Garczynski) discloses the use of an array sensor to optically scan the rank and suit of playing cards by comparing pixel images with pixel images stored in memory. One of ordinary skill recognizes the array scanner as a pixel-based CMOS image sensor. Prior art U.S. Pat. No. 6,126,166 (Lorson) verifies rank and suit of individual playing cards by moving each card past an array of reflective sensors to capture a bit-mapped image of the card indicia. The bit-mapped images are compared to verified bit maps which are stored in memory.

Prior art U.S. Pat. No. 6,403,908 (Stardust) discloses the use of optical recognition for inspecting decks of playing cards by utilizing a scanner or digital camera to scan one card indicia at a time. US'908 explains that images taken by cameras are supplied to a comparison circuit in the control processor which compares these images with stored images of a corresponding deck of cards to determine which card and what color card is detected by the camera or cameras. Digital cameras or scanners are used.

Prior art U.S. Pat. No. 6,676,127 (Johnson) discloses a collating apparatus for providing sorted and/or shuffled decks of playing cards which utilizes a CCD digital camera. US'127 discloses that the camera is utilized to read the rank and suit of a deck of cards as each card passes by a scanning station. The camera described in US'127 is model EB100/E-6 made by EverFocus® Electronics, which is a 492×510 pixel CMOS camera. US'127 states:

"Thus, the device of the present invention is capable of accounting for all cards, and for producing an error signal when there are too few or too many cards. The device may also be equipped with a display that provides a visual indication of the particular cards missing or extra cards present, or the total card count." (US'127 col. 4; lines 64-67, col. lines 1-2)

U.S. Pat. No. 5,722,893 (Hill) discloses an optical sensor used to scan the rank and suit of a playing card as a dealer removes each playing card from a card dispensing shoe. Verification is achieved by comparing bit maps form the sensor to bit maps that are stored in memory. US'893 states:

"The present invention is directed to a shoe of the type described wherein the shoe has a card scanner which scans indicia on a playing card as the card moves along and out of a chute by manual direction by the dealer in the normal fashion. The scanner can be one of several different types of devices which will sense each card as it is moved downwardly and out of the from of the shoe." (US'893 col. 1; lines 41-46).

Even with optical card recognition and verification means, mechanical shuffling machines are not infallible, and suffer from various errors caused by several sources including cheating, lost cards, flipped cards, contamination, bent cards and covertly inserted cards. The verification is useful however, because it can prevent further play with a card deck that suffers from various illicit conditions. For example, prior art U.S. Pat. No. 11,376,489 (Scheper) discloses the problem of the shuffler encountering lost cards or flipped cards. US'489 states:

"If the shuffler stops shuffling for any reason, such as detecting extra or fewer cards in the set, or due to a shuffler malfunction, the game may be delayed, and revenue can be lost. Although it is desirable to stop a game that is using an invalid set of cards for security reasons, there are other reasons why a game might be delayed, such as when a shuffler malfunctions or the shuffler aborts the shuffle because of unreadable cards." (US'489 col. 2; lines 57-67, col. 3; lines 1-2)

"Flipped cards and unrecognized cards typically cause the machine to abort the entire shuffle. Any time a shuffle is aborted, the game can be delayed, causing revenue loss to the casino." (US'489 col. 3; lines 5-14)

U.S. Pat. No. 11,173,383 (Krenn) discloses an apparatus to detect flipped cards in automatic shufflers, wherein the indica face of the playing card faces upward rather than downward. US'383 states:

"The card imaging device may be configured to identify whether a card face of the at least some of the playing cards are positioned in an expected orientation or whether the card face is in an unexpected orientation comprising one or more flipped cards." (US'383 30 col. 1; lines 67, col. 2; lines 1-4)

"When placing the cards in the discard pile and/or infeed area of a shuffling device, the dealer should reorient the cards face-down such that the cards are all oriented in the same way. However, cards are frequently reinserted into the card shuffling devices in the wrong face orientation. In additional embodiments, a new deck of cards may include cards in an erroneous orientation. Regardless of the case, cards inserted with the wrong face orientation may cause delays or errors in the automatic shufflers. For example, a card inserted in the wrong face orientation may cause the shuffling devices to stop the shuffle and alert the dealer through an error message or to abort the shuffle entirely resulting in a delay for the associated gaming table." (US'383 col. 5; lines 6-18)

Prior art U.S. Pat. No. 8,485,527 (Sampson) discusses the problem encountered by automatic shufflers due to damaged cards. US'527 states:

"Other mechanical shufflers frequently jam and thus fail to provide a shuffled deck ready for use in play without a delay while the shuffler is cleared and a complete deck is then shuffled. Casinos frequently replace the decks of cards in play, but nervous or careless players may bend cards, or spill drinks, making cards likely to stick together, leading to some shuffler jamming." (US'527 col. 1; lines 47-58)

U.S. Pat. No. 10,092,819 (Haushalter) discloses the problems of players or dealers cheating when utilizing automatic card shuffling machines. US'819 states:

"Automatic shufflers generally provide a higher level of randomization and security against cheating or mistakes compared to manual shuffling. However, players and dealers have been known to cheat or make mistakes that may lead one or more improper or unauthorized cards being introduced into a set of cards used in a particular game. For example, cards from another set may be inadvertently mixed with a set of cards being used, or a cheating player may attempt to introduce a card that is advantageous to the cheating player into the set of cards being used. Thus, true randomization of the cards may be compromised and the cheating player may gain an advantage." (US'819 col. 1; lines 26-37)

Some prior art shufflers cease operation of the shuffling operation when encountering "faulty" card sets, thus requiring dealer attention which stops casino game play. U.S. Pat. No. 10,238,954 (Stasson) explains that the card shuffler ceases operation if there is a mismatch in the number of expected cards. US'954 states:

"If so, the card shuffler 100 ceases operation and an error message is displayed on the data output device 296." (US'954 col. 23; lines 26-28).

Card damage in automatic shufflers is also dependent upon the complexity of the randomizing mechanisms. Several commercial shufflers use complex designs comprising a large array of individual card slots which are particularly prone to jamming due to bent or mildly warped cards. For example, several of today's commercial shuffling machines utilize the classic "Lorber Design" (U.S. Pat. No. 4,586,712) which is shown herein as FIG. 4. This classic configuration is based upon unloading cards from an unshuffled deck into the individual slots of a carousel, randomly rotating the carousel, and then pushing individual cards from the carousel slots and into a shoe.

As shown in the upper section of FIG. 4, an unshuffled card stack 2053 is deposited on edge into container 2052 of the automatic shuffling apparatus 2050. Individual cards are vertically stripped from the stack and moved downward from the left end of container 2052 and into a carousel 2062 by driven rollers 2054 and 2055. The carousel 2062 is described as a storage device 2060 which possesses a series of radially arranged addressable spaces 2064 which can be aligned with the edges of card stack 2053 of container 2052 for the purpose of inserting a card. A computer rotates a stepper motor (not shown) to insert cards in any random space within the carousel 2062. Individual cards are extracted from the randomly rotated carousel 2062 at the station shown in the bottom left section of the figure by the action of an ejecting device 2066. Driven rollers 2054 and 2055 move the individual cards into a newly created stack within the space 2068. The stack of cards within discharge portal 2068 has thus been arranged randomly (shuffled).

Other commercial shufflers use a linear version of the "Lorber Design", which substitutes a vertically moving linear comb mechanism for the carousel. For example, U.S. Pat. No. 6,254,096 (Grauzer) is shown herein as FIG. 5. Referring to FIG. 5, unshuffled cards are placed into an intake portal 2070 which possesses a card receiving well 2072. A stacked assembly of card receiving compartments 2080 is configured to move vertically under control of an elevator motor (not shown), which can position the compartments at random elevations under control of a microprocessor. Pick up roller assembly 2074 and pinch roller system 2076 then move individual cards into compartments 2082 which have been randomly elevated. The elevator is also thereafter randomly positioned for card removal at a lower level, whereupon a pusher 2078 pushes cards out of the compartments 2082 and into a card way 2086, which provides a channel for moving the cards. Ultimately, the cards are stacked below each other in a discharge portal 2084 and form a buffer stack "B".

U.S. Pat. No. 9,138,635 (Sines) explains that playing cards become bent or warped during play. US'635 states:

"Throughout the course of play, it is not unusual for card players to hold cards in their hand and to warp or bend cards. Cards can also become warped or bent from the method by which a player or the dealer places them on the table or picks them up from the table." (US'635 col. 5; lines 51-55)

U.S. Pat. No. 11,338,194 (Helgesen) is illustrated herein as FIG. 6. This patent discloses a more recent version of the vertical adaptation of the classic "Lorber Design" which utilizes a vertically oscillating comb with narrow card slots. As shown in FIG. 6, a card storage device 2100 possesses a vertically moving rack 2106 which comprises slotted assemblies 2102 and 2108 into which individual cards are inserted. US'194 explains that the card rack 2106 is configured to translate in the vertical direction along a linear path- and that the card storage device 2100 includes a motor 2110 configured to drive movement of the rack 2106 up and down in the vertical direction. Each card storage compartment has a slot 2104 in the first side bracket assembly 2102 and a corresponding and complementary slot 2104 in the second side bracket assembly 2108.

US'194 additionally discloses the intuitive observation that inserting bent or warped cards into narrow slots is problematic. US'194 states:

"For example, one card in a deck may be bent or warped—causing the card to regularly fail to insert into its assigned upper or lower position during each shuffle." (US'194 col. 28; lines 63-65)

A simpler, and therefore more reliable, randomizing mechanism was taught by prior art U.S. Pat. No. 5,683,085 (Johnson), which discloses a randomizing apparatus that is devoid of narrow-slotted combs, racks and compartments. As shown herein as FIG. 7, Johnson discloses a shuffling apparatus which possesses a "main shuffling chamber" 2200. A mechanical gripping member 2208 is attached to a mechanical gripping arm 2206 which can move vertically to random positions in chamber 2200 as commanded by a microprocessor. The arm 2206 grips and the lifts sub-stack 2202 at random positions which enables the insertion of an individual card 2210 from an unshuffled deck residing in intake portal 2212. The separating mechanism creates an opening between two sub-stacks 2202 and 2204, which allows the insertion of card 2210 from the intake portal 2212 into the receiving stack at the opening. US'085 simulates the well known action that a dealer utilizes to manually insert a "cut card" into a deck as illustrated herein as FIG. 8A.

Prior art U.S. Pat. No. 6,651,982 (Grauzer) also adopted the Johnson gripper mechanism. Whereas US'085 has elevated the gripper to select a subset of cards, US'982 discloses that the gripper is held stationary, while the platform below is vertically lowered away from the gripper. The shuffler described in US'982 has a disadvantage because only one deck can be processed at a time. The elevator is used to support the final shuffled card deck in the discharge portal, thus preventing the use of the elevator for additional shuffling until the deck is removed by the dealer. U.S. Pat. No. 6,250,632 (Albrecht) discloses a shuffler with an elevator that suffers from the same problem. That shuffler cannot operate until a previously shuffled deck has been removed from the elevator at the discharge portal by the dealer.

The Johnson Method as shown in FIG. 7 of U.S. Pat. No. 5,683,085 can be further understood from FIGS. 8B and 8C where a generic gripper arm is labeled 640. The gripper arm is mounted to an elevator which positions the arm at a random vertical plane adjacent to the card stack 620 as shown in FIG. 8B. The gripper arm thereafter grasps a portion of the card stack 620U and lifts it upward, creating an opening to insert a playing card 626. The gripper arm then lowers the upper stack onto the lower stack. The cycle is repeated until the desired number of cards are inserted randomly into the card stack 620.

U.S. Pat. No. 6,651,982 also utilized a gripper to separate a card stack into two sub-stacks. Referring to FIGS. 8D and 8E, US'982 mounted a gripper arm 640 in a vertically stationary position and instead moved the card stack 620 with the elevator. After splitting the stack 620, the sub-stack 620L was lowered to create the opening for inserting card 626. After insertion, the lower substack 620L was raised to abut against the upper sub-stack 620U and the gripper was released. As compared to US'085, US'982 lowered the lower sub-stack 620L rather than raising the upper sub-stack 620U as was taught by US'085.

Many prior art mechanical shufflers require multiple elevators or multiple intake portals. U.S. Pat. No. 6,361,044 (Block) allows multiple decks to be sequentially prepared for play. US'044 discloses a mechanical shuffler which is embedded in a casino table, where the shuffled card deck is raised by an elevator to a discharge portal at the surface of the casino table. The shuffled deck is obscured from visibility of the players by an automatically moveable hinged cover over the discharge portal. However, US'044 requires multiple elevators and a large complex machine with serpentine card movement paths.

U.S. Pat. No. 7,523,935 (Grauzer) also disclosed a shuffler that was embedded into a casino table, such that the card intake portal and the card discharge portal were approximately flush with the casino table surface. Like US'044, US'935 also disclosed that an automatically moveable cover could be utilized to obscure view of the shuffled cards residing at the discharge portal. US'935 however was disadvantaged because the shuffling operation for a second deck could not commence until a previously shuffled deck had been removed from the elevator surface that is parked at the discharge portal.

Other prior art discloses overly complex devices. U.S. Pat. No. 7,584,962 (Breeding) requires three elevators to shuffle one deck of cards. U.S. Pat. No. 10,960,292 (Stasson) and US Published Application No. 2020/0171375 (Litman) both require two elevators in addition to a narrow-slotted comb. U.S. Pat. No. 11,376,489 (Scheper) requires both an elevator and a narrow-slotted carousel. U.S. Pat. No. 7,766,333 (Stardust) requires four intake portals to shuffle one deck of cards. U.S. Pat. No. 6,726,205 B1 (Purton) requires two elevators to verify a single card deck utilizing a digital camera. U.S. Pat. No. 5,718,427 discloses a mechanical shuffler that requires two unshuffled card intake portals and a third discharge portal in order to shuffle a single deck.

U.S. Pat. No. 7,784,790 (Grauzer) explains a "continuous shuffler" type that uses a rack of vertically arranged compartments for randomizing, in the same way as carousel shufflers. Multiple decks of cards are recirculated through the shuffler as a card game is played, and sensors are utilized to resupply continuous randomized cards to the discharge shoe as the dealer removes them. Spent cards are inserted periodically to the intake portal by the dealer. The apparatus of US'790 cannot assure the security of the cards because it cannot detect if a player or dealer has covertly inserted or extracted cards during the continuing operation. This security problem is an exemplary characteristic of "continuous shufflers" types. While they offer a continuous supply of cards, the cards are insecure unless the game is stopped, and all cards are rounded up and interrogated.

US'790 explains that the dealer (the apparatus user) must periodically halt the apparatus and the card game to perform a security check. The cards on the casino table must be rounded up, and the combined group of cards (up to 4 decks) must be entered into the intake portal to be interrogated by the apparatus. Below is an excerpt from claim 20 of US'790.

> "the microprocessor is programmed to: receive signals from sensors and count cards entering and being removed from the shuffling chamber and to maintain a count of cards present in the shuffling chamber; receive instructions from an apparatus user to initiate a card counting process, wherein the card counting process includes a) discontinuing operation of the card removal process, b) pausing until cards outside of the shuffling chamber are loaded into the shuffling chamber, c) receiving an indication from the at least one sensor of i) sensing the presence of a card as the card is being fed into the shuffling chamber."

In view of the various complex designs that detrimentally influence reliability, a simple reliable mechanical shuffler is needed that can overcome the problems that can shut down a shuffling apparatus in the view of sustaining continuous game play. When the dealer reaches for the newly shuffled deck, it may not be ready for play because of the many problems as described above. The newly shuffled deck may need to be re-shuffled or discarded, thus delaying continuation of the game. What is needed is a reliable, simple and compact shuffling apparatus and method which facilitates continuous play at a casino table without interruption, utilizing securely interrogated cards. When the dealer reaches for the newly shuffled deck in the discharge portal, he must be assured that such a deck has both been properly verified and sufficiently randomized.

SUMMARY

One solution to the many problems explained in the prior art is to introduce a reliable, automatic shuffler device that can maintain a multiple deck rotation that incorporates at least three decks. Such a solution requires that a shuffled and verified deck is available to the dealer at the moment that he/she decides to retire the deck that is being played to the shuffler. In a three-deck deck rotation, two previously-shuffled decks are available when the dealer discards an unshuffled deck to the shuffling apparatus. If one of the two previously shuffled decks is faulty (failed verification), then the dealer may chose the other deck. Statistically, there is little chance that both previously shuffled decks will be faulty, with the result that there will be no interruptions in the rate of play.

The apparatus and method of an embodiment of the present invention utilizes a card handling apparatus which includes one unshuffled card intake portal and one card deck discharge portal, which may be arranged side-by-side on the device housing and readily accessible to a dealer. The ready-to-play card deck in the shuffled deck discharge portal is supported by a retractable support structure. The apparatus possesses a randomizing mechanism for shuffling the cards, and an optical recognition sensor configured to verify the integrity of the deck by reading the rank and suit of each card. A first shuffled card deck is delivered as a "ready deck" to the shuffled deck discharge portal where it is supported by a retractable support structure. Thereafter, a second shuffled deck is created. The second deck is designated as the "reserve deck", and is supported by an elevator just below the "ready deck" where it is not visible to the players or the dealer. This position of the elevator, while supporting the "ready deck" just below the "reserve deck", is referred to as the elevator's "footprint position". The "reserve deck" is not visible to either the players or the dealer. The verification status of the "ready deck" and the "reserve deck" are both visibly observable by the dealer at the control panel such that the dealer can anticipate and remediate future delays. An embodiment of the present invention requires only one elevator to prepare multiple play-ready decks.

The invention herein utilizes a single elevator to automatically verify and/or shuffle multiple discrete decks of cards. This is not to be confused with those devices that shuffle multiple decks of cards by intermixing the individual decks. For example, the device described in prior art U.S. Pat. No. 8,899,587 (Grauzer) can shuffle two decks of cards, but it is unable to keep the two decks separated into sets, and instead describes combining two 52-card decks into one set of 104 cards. The apparatus in US'587 has no capability to keep the individual decks separated into sets.

The randomizing mechanism of an embodiment of the present invention is devoid of narrow slots, carousels, combs or racks that are previously known to be vulnerable to jamming. A section of the card stack being randomized is raised by a gripper mechanism which creates a randomly-chosen wedge-shaped opening for oblique insertion of a card from the unshuffled stack, and thereafter lowers the raised stack portion. The large wedge-shaped opening is tolerant of the elevator position during card insertion, thereby reducing the vulnerability to bent or warped cards, as is the problem with narrow-slotted mechanical shufflers.

As a card game is played, exhausted card hands are discarded to the card intake portal by a dealer until such time that the dealer decides to retire the entirety of that deck to the card intake portal for shuffling. The dealer pushes a button that commands that deck to be shuffled, picks a previously-shuffled card deck (the "ready deck") from the deck discharge portal, and then continues the card game that is in progress. The shuffling machine detects that the "ready deck" has been removed, and thereafter moves a previously shuffled "reserve deck" to the deck discharge portal. The "reserve deck" thereafter assumes the "ready deck" position in the discharge portal. The microcontroller thereafter begins the randomization/verification cycle with the deck residing in the intake portal. When the machine completes the verification and shuffling task, the newly-shuffled deck is moved to the "reserve deck" position, and the verification status of that deck is indicated on the control panel.

The apparatus is advantageous because it provides two play-ready shuffled decks to a dealer at the time that he retires a spent deck to be shuffled. Should one deck be faulty resulting from verification, the dealer may extract the second deck. Statistically, the chance of two faulty decks is significantly lower than encountering only one faulty deck. As a result, the dealer has a higher probability of continuing a card game without interruptions, than if only one deck had been shuffled. The apparatus thus provides a continuous supply of card decks that have been scrutinized or interrogated for security purposes, while assuring continuous card play.

One advantage of the verification mechanism of an embodiment of the present invention is that friction rollers are used to individually move the playing cards past the optical reader. The friction rollers strip each playing card relative to an adjacent playing card, regardless of stickiness between adjacent playing cards that might be introduced by snacks or beverages being used at the casino table. The friction roller strippers increase the likelihood that each playing card will be successfully read during the verification process.

Another advantage of an embodiment of the present invention is that the wedge-shaped insertion opening makes the apparatus tolerant of elevator positional error when inserting bent or warped playing cards.

Another advantage of an embodiment of the present invention is the simplicity and reliability of the randomizing mechanism which utilizes only one elevator and avoids the complexity, high manufacturing costs and jamming vulnerability associated with narrow-slotted randomizing mechanisms and multi-elevator shufflers.

A yet further advantage of an embodiment of the present invention is that the service life of the elevator components is extended in comparison to other devices that utilize gripper mechanisms to separate a card stack. While the prior art elevators require three shuttling motions to insert each card, embodiments of the present invention herein require only one shuttling motion.

BRIEF DESCRIPTION OF THE DRAWINGS

FIGS. 12A and 12B are side elevational views of the apparatus which stepwise illustrate the migration of playing cards as they move through the apparatus.

FIG. 13 is an isometric view of the elevator module of the present invention.

FIG. 14 is an isometric view of the elevator module showing the position of a subset of randomized cards.

FIG. 15 is an isometric view of the of the gripper mechanism which is used to grasp and raise a sub-stack of randomized cards.

FIG. 16 is a planar view of the gripper mechanism used to randomize cards.

FIG. 17 is an isometric view of the gripper mechanism while grasping a stack of cards.

FIG. 20 is a side elevational section view of the randomizing apparatus showing the receiving card stack after the upper sub-stack has been lowered onto the newly inserted card by the gripper mechanism.

FIG. 21 is an isometric view of the shuffled card stack being raised to the card deck discharge portal.

FIGS. 29A and 29B show two exemplary illustrations of the receiving card stack numbering sequence utilized by the randomizing method.

FIG. 30 shows a section view of the apparatus whereupon a first "ready deck" is positioned in the card deck discharge portal and a second "reserve deck" is positioned in its footprint while both are ready for game table play. A third unshuffled deck is awaiting randomization while positioned in the card intake portal.

DETAILED DESCRIPTION

A card handling apparatus for automatically shuffling and verifying multiple decks of playing cards is described for use in casino card games such as blackjack or twenty-one which are hosted by a card dealer at a casino table, although the card handling apparatus can be used with other card games played in a casino without departing from scope of the invention.

For purposes of this explanation, the term "spent deck" is defined as a deck of cards having been used in a card game previously and in need of being shuffled and verified. The term "processed deck" is defined as a deck of cards that has been transformed from a "spent deck" into a shuffled (randomized) deck, and has additionally been interrogated by the apparatus described herein. The term "card intake portal" is defined as the depository cavity within the housing of the invention whereupon a new or spent deck is deposited by the dealer for the purpose of being transformed into a processed (shuffled and verified) deck. The term "card deck discharge portal" is defined as the cavity within the apparatus housing where the processed decks are deposited by the apparatus for removal by a dealer.

Figure 9:
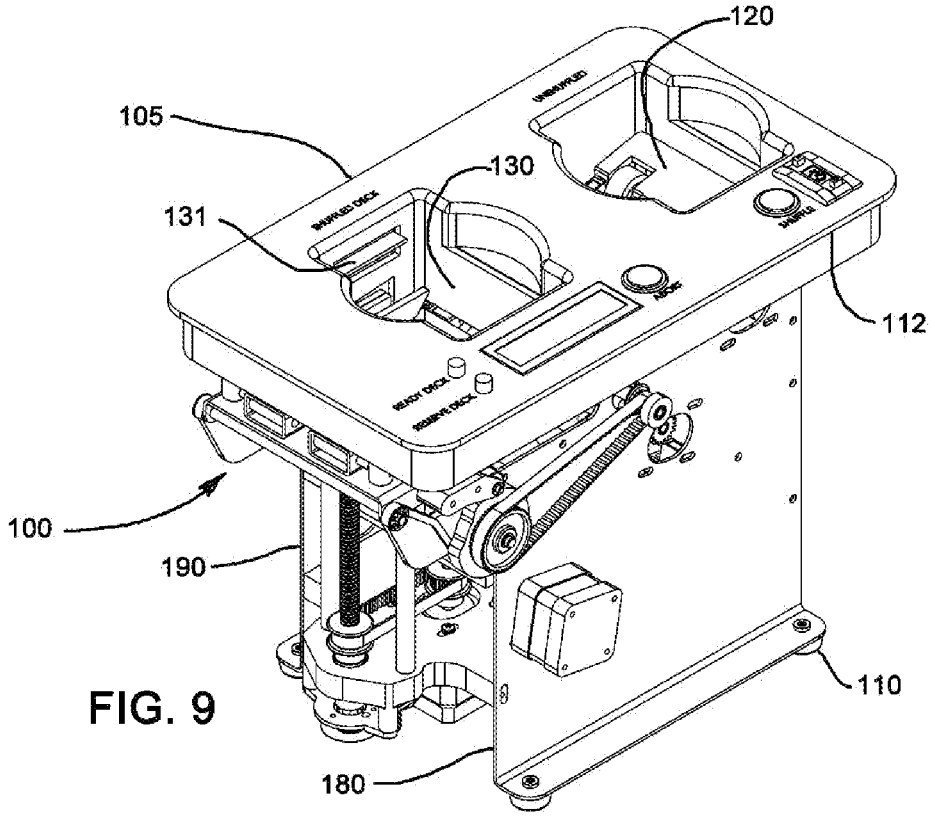
FIG. 9 is a perspective view of the card shuffling and verification apparatus being described herein.

An isometric view of the mechanical shuffling apparatus 100 is shown in FIG. 9. The apparatus 100 comprises a control console 105 which includes a recessed card intake portal 120 for receiving a new or spent (unshuffled) deck of playing cards from a dealer, and a recessed card deck discharge portal 130 for receiving a processed deck of playing cards from the randomizing mechanism that resides below. The recessed portal 130 includes a retractable support structure 131 whose purpose is to support a deck of cards. Frames 180 and 190 support the mechanism of the apparatus and mount to the underside of the control console 105.

The apparatus 100 may be inserted into a cavity in a casino table surface such that only the control console 105 is visible to the dealer and the casino players. Alternatively, the apparatus 100 may reside on the top surface of a casino table, supported by rubber feet 110 (see FIG. 9). A housing (not shown) would be added for the tabletop application. In the embedded table configuration, the lip 112 is intended to rest upon the table surface, thus supporting the apparatus 100 which is placed near the dealer within arm's reach, such that the dealer may easily insert and withdraw card decks from the recessed portals 120, 130. When mounted into the casino table, the table surface will completely or partially surround the periphery of control console 105. The apparatus additionally possesses rubber feet 110 which support the apparatus 100 when removed from the casino table for service or maintenance.

A goal of the apparatus 100 is to prepare card decks for play by shuffling those decks (randomizing) and interrogating those decks for irregularities such as missing cards or unreadable cards, and to thereafter make those decks available to the dealer. A further goal is to provide a "ready deck" in the card deck discharge portal and another play-ready "reserve deck" in a location below the "ready deck", such that both are available when the dealer retires a new or spent deck to the card intake portal. The apparatus 100 signals the dealer if the "Ready Deck" or "Reserve Deck" have been found to be faulty, such that the dealer may immediately discard the faulty deck. The apparatus 100 additionally allows the dealer to queue up three decks at the beginning of a card game or shift.

Figure 10:
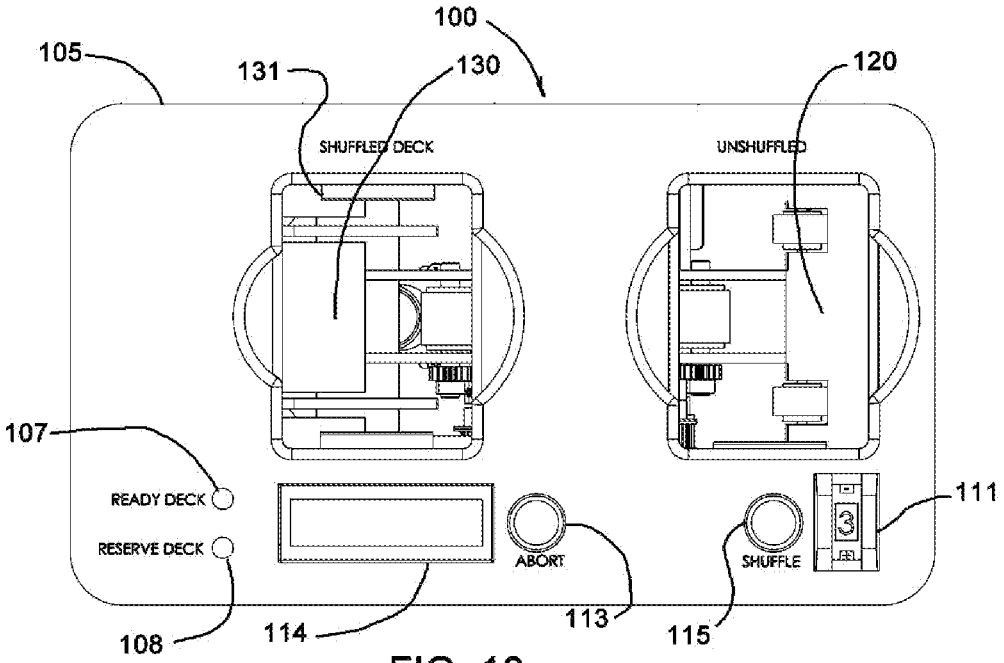
FIG. 10 is a view of the console control panel of the apparatus in FIG. 10, as viewed by the dealer.

FIG. 10 shows one embodiment of a console and its controls as viewed from above by a dealer. In front of the two recessed portals 120, 130 are various indicators and buttons 107, 108, 111, 113, 114, 115 used to control the apparatus 100. A "push switch" 111 is located at the lower right of the console and is used to set the "mode" of the shuffling apparatus. The "mode" establishes the parameters for different card games or different activities. For example, "MODE 3" might be the mode for establishing the parameters for a blackjack game which instructs the apparatus that each deck must possess 52 cards, no jokers, and that each deck must be randomized. As another example, "MODE 4" might be a mode that instructs the machine to process a deck to verify the integrity of a 52 card deck without randomizing. The digit display on a "push switch" is incremented by pushing either the plus or minus button which reside above and below the numerical digit readout of the push switch 111.

The control console 105 additionally possesses a SHUFFLE button 115 which is used by the dealer to commence operation of the apparatus, and an ABORT button 113 which is used to stop the operation of the apparatus in the case of a failure. A 2×16 character display 114 displays fault messages to the dealer. Examples of such display messages are "READY DECK IS VERIFIED", "RESERVE DECK TOO MANY SPADES" or "RESERVE DECK UNREADABLE CARD".

The control console 105 additionally possesses two status LED's 107 and 108 that indicate the status of the "Ready Deck" and "Reserve Deck". The indicators are bi-color LED's which may show either red or green lighting. A green light indicates that a given deck is verified, randomized and ready for play, while a red light indicates that the deck has been found to be faulty. The purpose of these indicators is to allow the dealer to "look ahead" for the status of the "Reserve Deck" when the dealer removes the "Ready Deck" from the deck discharge portal 130. Other LED colors may be utilized. Although not shown, the deck discharge portal 130 may have a hinged cover to prevent viewability of the cards contained within that recess, as taught by the prior art.

FIG. 30 shows the "Ready Deck" 630(1) residing in the discharge portal 130, with the "Reserve Deck" 630(2) residing just below. The process of removing the "Ready Deck" from the portal 130 triggers a sensor which instructs the microcontroller to immediately relocate the "Reserve Deck" to the deck discharge portal 130. The dealer can then discard that "Reserve Deck" if it was found to be faulty, while continuing game play with the "Ready Deck". While the table game continues, the previously played unshuffled deck can undergo processing.

Figure 11:
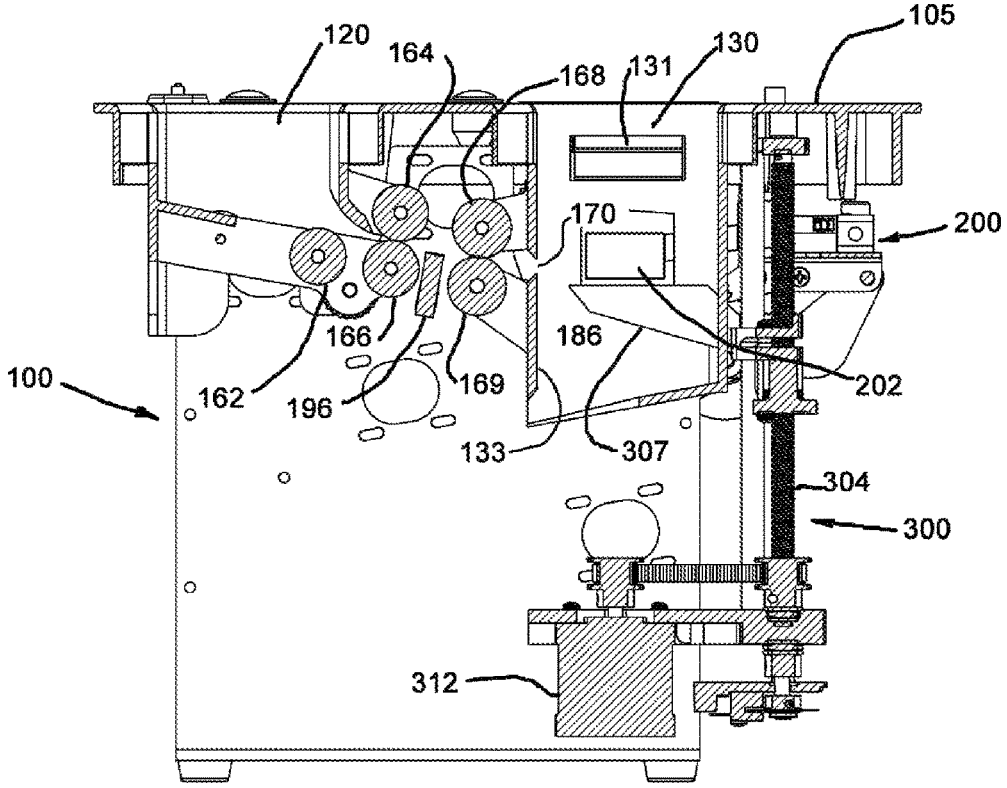
FIG. 11 is a side elevational section view of the apparatus herein.

The anatomy of the apparatus 100 is briefly explained by the section view shown in FIG. 11 which is devoid of any card decks or stacks. This view is looking into the apparatus 100 from the side of the casino table players. The card intake portal 120 is shown near the top left of the view. Feed rolls 162, 166 and 164 are utilized to move individual cards past an optical recognition sensor 196, and additional feed rolls 168 and 169 move individual cards into the randomizing chamber 186. After the deck is randomized, an elevator assembly 300 lifts the processed deck to a retractable support structure 131 which is located in the card deck discharge portal 130. The "processed deck" nomenclature reflects the fact that card decks which are delivered to the portal 130 have been processed both by optical interrogation and randomization. In the description that follows, it is apparent that the apparatus 100 may also be used to optically interrogate (verify) card decks without utilizing the randomization cycle, as described by the function of the mode switch 111 setting above.

Figure 12A:
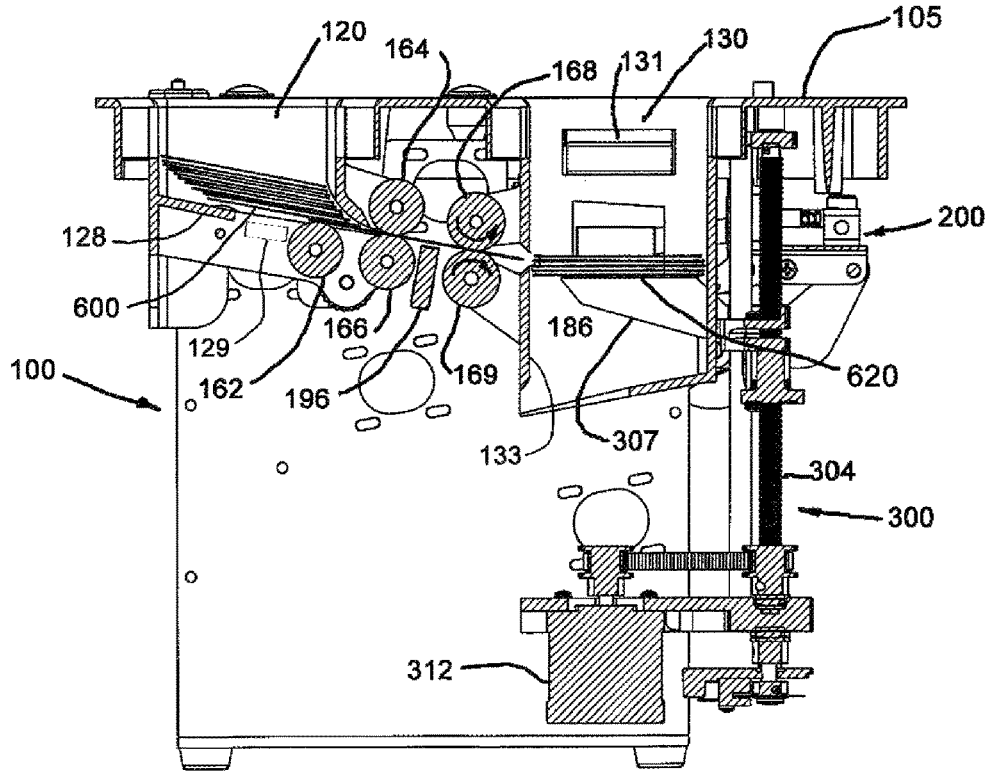

A more detailed explanation can be observed from FIGS. 12A and 12B, which explain the movement of a single card deck within the apparatus 100. FIG. 12A shows a new or spent deck 600 (unshuffled) located in the card intake portal 120. The cards 600 are supported by a shelf 128 and roller 162 that are located at the base of the intake portal. When the dealer activates the SHUFFLE button 115, a microcontroller (not shown) interrogates sensor 129 to determine if any card is present in the portal 120. Sensor 138 (see FIG. 24A) senses the absence or presence of a "Ready Deck" at card discharge portal 130. Elevator encoder 310 (see FIG. 28) is utilized to determine if the elevator is holding a processed deck in the "Reserve Deck" position. If a card is detected by the sensor 129 and either of the "ready deck" or "reserve deck" positions are vacant as determined by the sensor 138 or encoder 310, the microcontroller (not shown) will activate motors (not shown) that rotate feed rolls 162, 166 and 164 until the leading edge of a card is detected by optical recognition sensor 196.

In FIG. 12A, an unshuffled card is moving past the optical recognition sensor 196 and into the randomizing chamber 186, where the card stack 620 is supported by elevator arms 307 of the elevator assembly 300. The microcontroller activates a motor (not shown) to rotate feed rolls 168 and 169 which feed the card into the randomizing chamber 186 through a slot 170 (see FIG. 11) in the housing 133. The optical recognition sensor 196 is utilized to read the rank and suit of each card, in addition to counting the cards in the deck. The sensor 196 may be any optical recognition sensor as taught in the prior art, including a digital camera, CMOS camera, color pixel sensor or a CCD image sensor. In the preferred embodiment, the sensor 196 is a color pixel sensor and is used to read the rank and suit in the upper right corner of each card. This optical recognition process will continue until sensor 129 signals that no more cards are available in the portal 120. Upon completion of the deck insertion into the randomizing chamber 186, the microcontroller will determine if any fault condition exists, including card shortages, extra cards, flipped cards or unreadable cards.

The randomizing cycle will be explained below. After the randomizing cycle is completed, a processed card deck will reside upon elevator arms 307 within the chamber 186. The elevator arms 307 will thereafter raise the randomized (shuffled) card deck 630 to the card deck discharge portal 130 as shown in FIG. 12B, and transfer the randomized (shuffled) card deck 630 to the retractable support structure 131. The first processed deck placed into this position upon the retractable support structure 131 is designated as the "ready deck". The green indicator LED 117 will be activated if that deck has no faults. The elevator arms 307 will then withdraw to the randomizing chamber 186 such that another unshuffled deck can be processed while the "ready deck" is available in the card deck discharge portal 130.

The randomizing cycle comprises a series of motions performed by the apparatus 100 to sort the individual cards into a randomly arranged deck within the randomizing chamber 186. The randomizing cycle will automatically start when the dealer activates the "Shuffle" command button 112 as shown in FIG. 10, as long as sensor 129 detects the presence of a card and the count of the elevator encoder 310 (see FIG. 28) indicates that the elevator is available for randomizing. Referring to FIG. 12A, a series of feed rolls 162, 166, and 164 strip the bottom card from the stack and move that card past the optical recognition sensor 196. The optical recognition sensor 196 acts in concert with the microcontroller to count each card, and to identify the rank and suit of each card which passes between feed roll 166 and feed roll 169. Feed rolls 168 and 169 then inject each card into the randomizing chamber 186, whereupon each card is inserted into a growing card stack.

The randomizing chamber 186 possesses an elevator surface which is defined by support arms 307 which support the card stack during randomization, and moves the card stack with oscillation motion in the vertical direction within the randomizing chamber 186 (FIG. 12A). The structure of the elevator assembly 300, its elevator arms 307 and its associated motor 312 is shown in FIG. 13.

An elevator support surface consists of two fork-shaped elevator arms 307, which are moved vertically by motion of a lead screw 304. The elevator arms 307 possess flat surfaces 307A and 307B which support card stacks. Guide shafts 324 and 322 prevent torsional movement of the elevator arms 307, and are attached to platform 318 to which a stepper motor 312 is mounted on one side and a bracket 320 on the other side. The stepper motor 312 rotates the lead screw 304 by means of a timing belt 308. The orientation of a card stack 620 is shown when in transit on the elevator in FIG. 14. As shown in FIG. 12A, the two elevator arms 307 of the elevator assembly 300 penetrate the randomizing chamber 186 through access slots (see 835 in FIG. 27A) in the wall of the randomizing chamber 186, such that the elevator arms 307 may move freely in the vertical direction. At the same time, the card stack on the elevator arms 307 is constrained on four sides by walls 133A, 133B 133C and 133D (see FIG. 22) of randomizing chamber 186.

Figure 28:
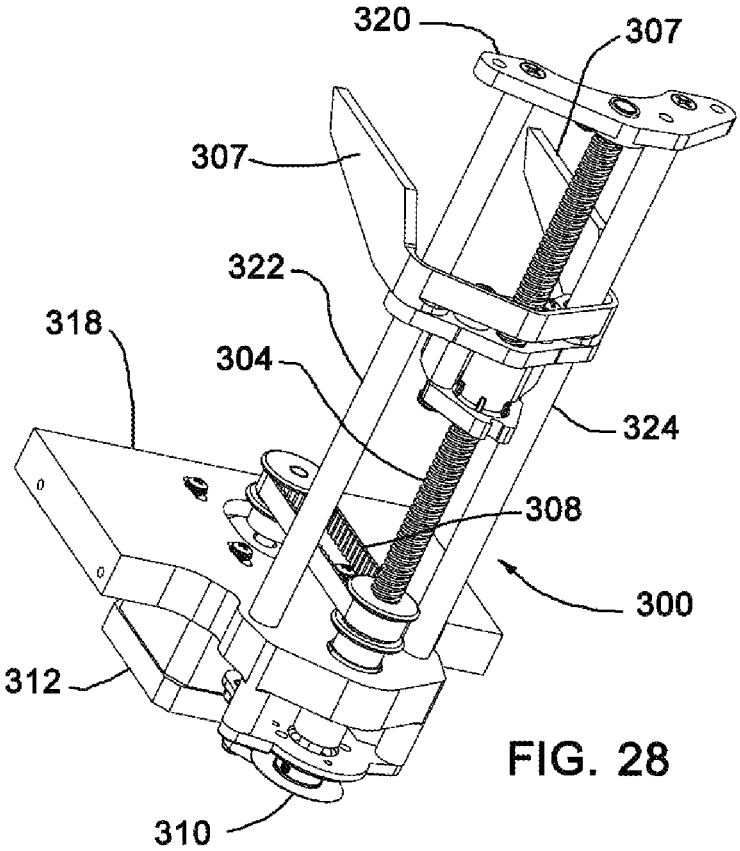
FIG. 28 shows an isometric view of the elevator with its incremental encoder.

The elevator arm 307 movement is controlled in very fine increments by the step motor 312 in conjunction with an incremental encoder 310 which is mounted to the lead screw 304 as shown in FIG. 28. An encoder disc of the incremental encoder 310 has 200 increments per revolution which corresponds to each step of a 200 step per revolution step motor. The ratio of the lead screw 304 rotation to the elevator arm 307 vertical motion is 4 millimeters per turn. The step motor 312 can therefore control the vertical elevator motion in increments of 20 microns, where 1 micron equals one-millionth of a meter. The thickness of a typical playing card is approximately 300 microns. Thus, the step motor 312 can therefore move the elevator arms 307 with the precision of 1/15th of the card thickness. In other words, 15 motor steps moves the elevator arms 307 one card thickness. This high ratio makes the elevator arms 307 controllable in fine increments, thus intolerant to positional error. Upon initial powering of the apparatus 100, the microcontroller moves the elevator arms 307 down to a home position and sets the encoder count to zero. Thereafter, the encoder count is used by the microcontroller as a position sensor to check the elevation state of the elevator arms 307. For example, the microcontroller uses the encoder count to detect the state where the elevator is parked in the "reserve deck" position.

A gripper assembly 200 performs the function of the human hand to grasp a card stack 620 as shown in FIG. 17. A gripper portion of the gripper assembly 200 is shown in FIG. 16. Two gripper pads 202 are mounted on the terminal ends of a first gripper arm 203 and a second gripper arm 204, which each pivot upon pivot screws 206. The two arms are actuated by two small solenoids 207 and 208 which are mounted on the gripper frame 210. When the solenoids are activated, the arms 203, 204 and their associated pads 202 move in the direction of the arrows to pinch the lateral surfaces of a card stack. Upon deactivation of the solenoids 207, 208, the two arms 203, 204 are moved in the reverse direction by spring 212, which relaxes the grip and releases the card stack 620. In the relaxed position, there exists only slight clearance between the gripper pads 202 and the lateral surface of card stack 620.

The complete gripper assembly 200 is shown in FIG. 15 where the gripper assembly 200 is pivotally mounted on a shaft 209. The pivotal mount allows the gripper frame 210, including gripper arms 203 and 204, to move in an arc after the gripper solenoids 207, 208 have been activated. A cam follower roll 222 is mounted to the follower mount 218 which is rigidly attached to the gripper frame 210. During the gripping cycle, at least one card of the card stack 620 is grasped by the gripper arms 203 and 204, and thereafter lifted by the cam 220 to move an upper sub-stack of cards 620U upward through an arc and separates the cards into an upper sub-stack 620U and a lower sub-stack 620L as shown in FIG. 18 and FIG. 19.

The elevator assembly 300 is used to position a card stack relative to the gripper mechanism 200, in order to allow the gripper assembly 200 to split the card stack into two sub-stacks, 620U, 620L. The orientation between the elevated, upper sub-stack 620U, the gripper assembly 200, the lower sub-stack 620L, and the elevator assembly 300 is shown in FIG. 18. A lower card sub-stack 620L is shown supported by the elevator arms 307, while an upper card sub-stack 620U is shown lifted in an arc about pivot P1 which is locationally fixed to the frame of apparatus 100. The vertical position of the split 326 between the upper sub-stack 620U and the lower sub-stack 620L is determined by the microcontroller which relocates the elevator arms 307 just prior to the gripping cycle. As shown in FIG. 18 and FIG. 19, the elevator arms 307 position a card stack 620 in a randomly selected vertical elevation and the gripper assembly 200 thereafter splits the cards stack through an arc at that random location. The lower sub-stack 620L is held stationary by the elevator arms 307 while the gripper arms 203, 204 rotates the upper sub-stack 620U, and while a new card 622 is inserted into the wedge-shaped opening 326. The purpose of the arcuate movement of the gripper assembly 200 is to create a wedge-shaped opening 326 which is tolerant to curved or bent cards.

Figure 18:
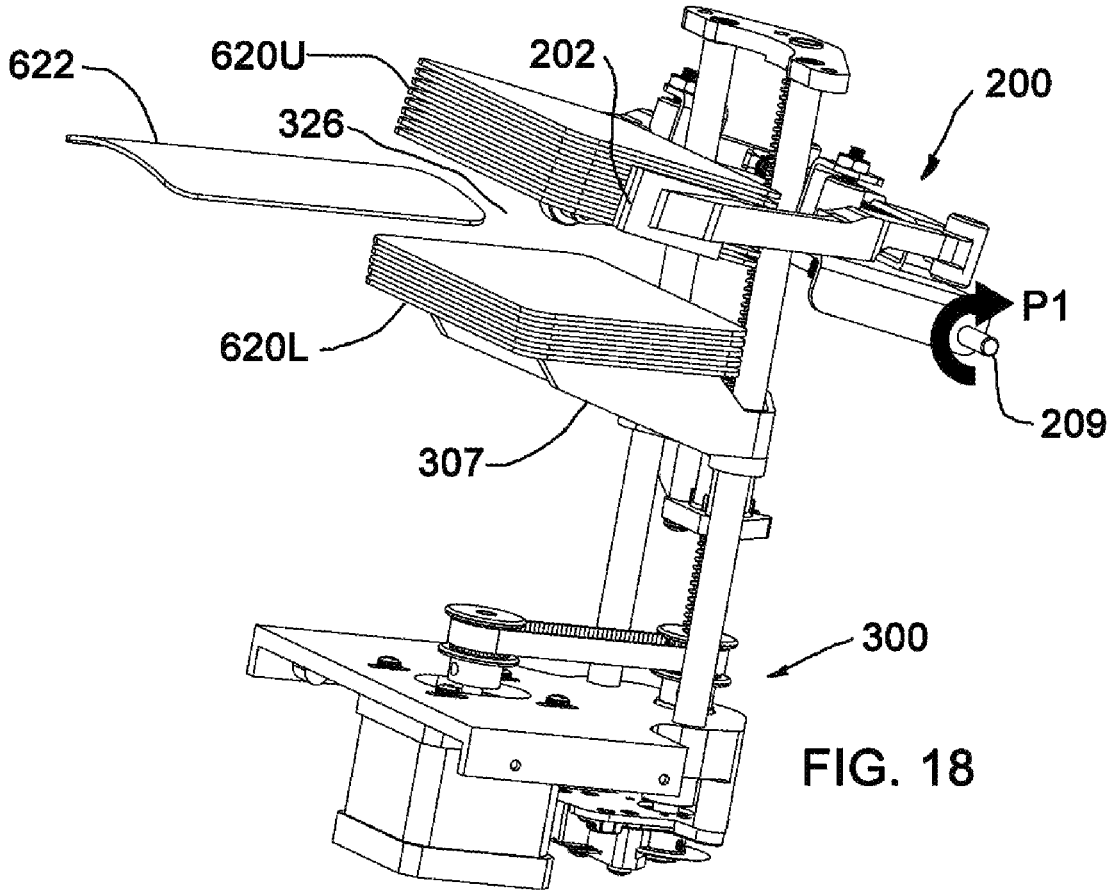
FIG. 18 is an isometric view of the gripper mechanism creating a random wedge-shaped opening between two sub-stacks of cards.
Figure 19:
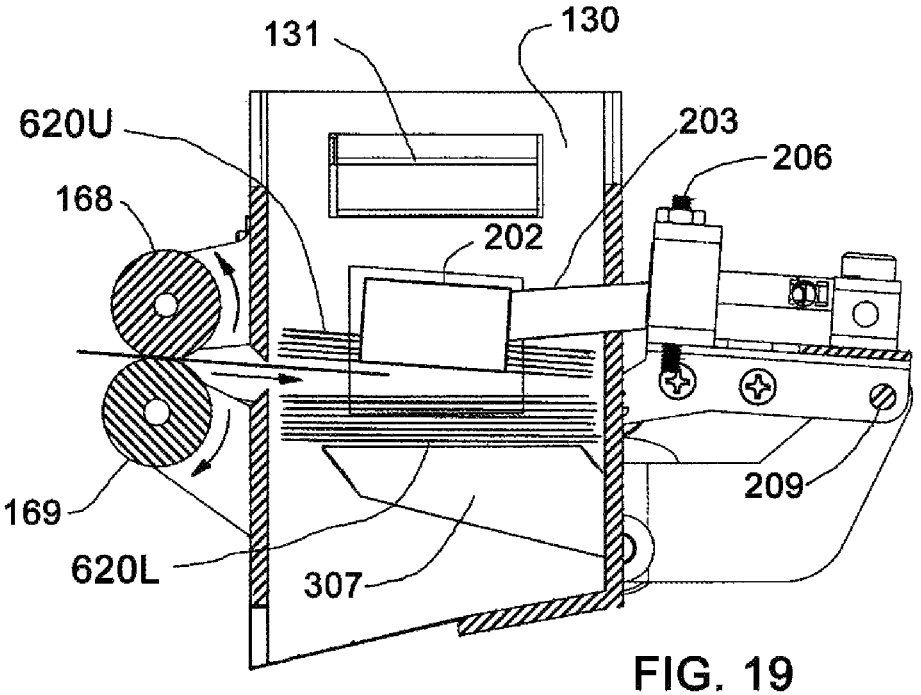
FIG. 19 is a cutaway side view of the randomizing apparatus showing a card being inserted into a randomly-created wedge-shaped opening in the receiving card stack.

The wedge-shaped opening 326 shown in FIG. 18 is created for the purpose of injecting a card from the unshuffled stack as shown in the side view of the randomizing chamber 186 in FIG. 19. The purpose of the wedge-shaped opening 326 is to provide a tolerant gap for warped cards such as card 622 as shown in FIG. 18. The injected card is stripped from the bottom of the unshuffled card deck as shown in FIG. 12A. Feed rolls 168 and 169 as shown in FIG. 19 move the stripped card into the wedge-shaped opening 326. In FIG. 20, the gripper pads 202 are deactivated, after the gripper assembly 200 has been lowered, allowing the upper sub-stack 620U to rest upon the newly inserted card. The feed rolls 168 and 169 are shown isometrically in FIG. 15, where they are shown controlled by stepper motor 250 via pinions 246 and 248. The feeding motion of the unshuffled card into the chamber 186 is synchronized with the cam-actuated creation of the wedge-shaped opening 326 by means of the timing belt 230 and the twin gears 237 and 238. Feed rolls 169 are fixedly attached to shaft 234, which is rotationally driven by pinions 238 and 237 and ultimately driven by motor pinion 248 of step motor 250. Timing belt pulley 232 is fixedly attached to shaft 234 and rotationally drives cam 220 via timing belt 230 such that the motion of cam 220 is synchronized with the rotation of feed rolls 168 and 169.

Figure 1:
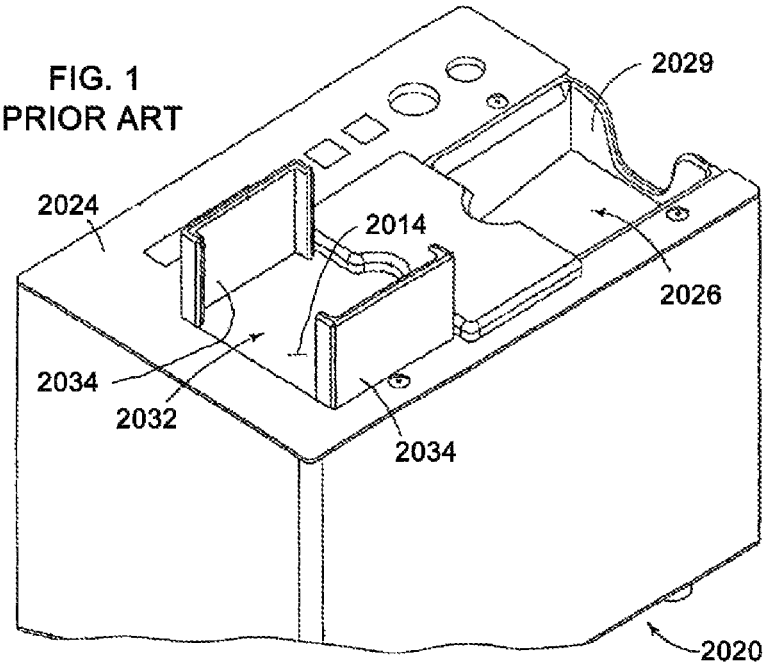
FIG. 1 PRIOR ART
FIG. 1 shows a prior art example of a shuffling machine console which includes a card receiving intake portal and a shuffled card discharge portal.
Figure 2:
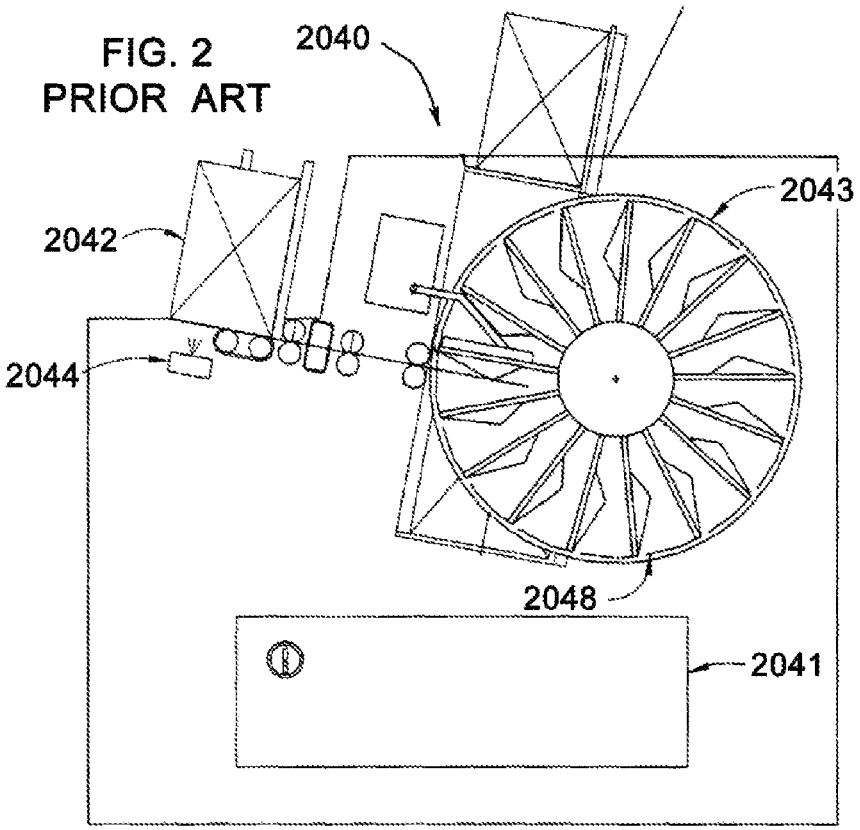
FIG. 2 PRIOR ART
FIG. 2 shows the configuration of a prior art carousel-type automatic shuffler that utilizes an optical reader to verify the composition and completeness of a set of playing cards during the randomizing process.
Figure 3:
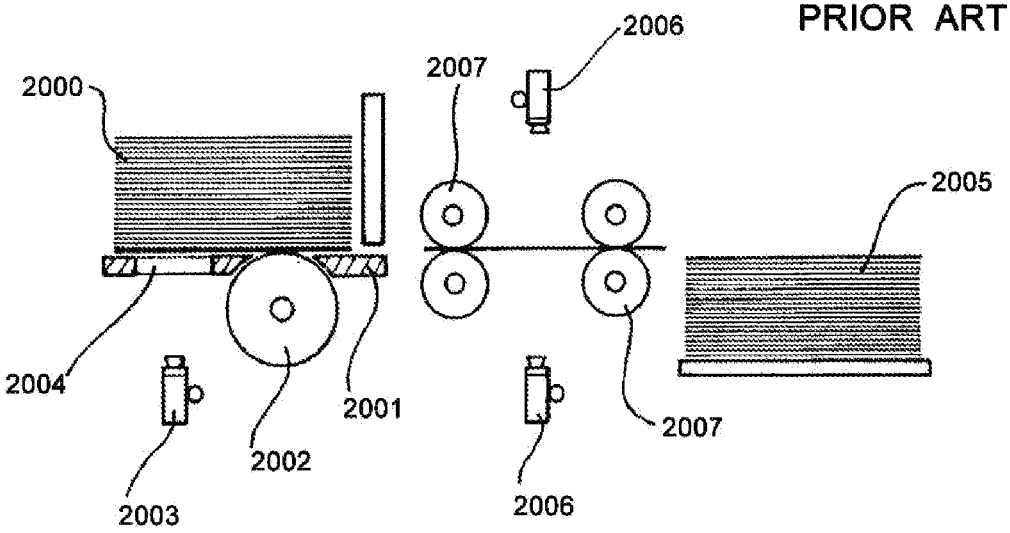
FIG. 3 PRIOR ART
FIG. 3 shows alternative arrangements of a prior art digital camera configured to verify a stack of cards by using optical recognition to inspect rank and suit of each card as a machine passes each playing card from one stack to another.
Figure 4:
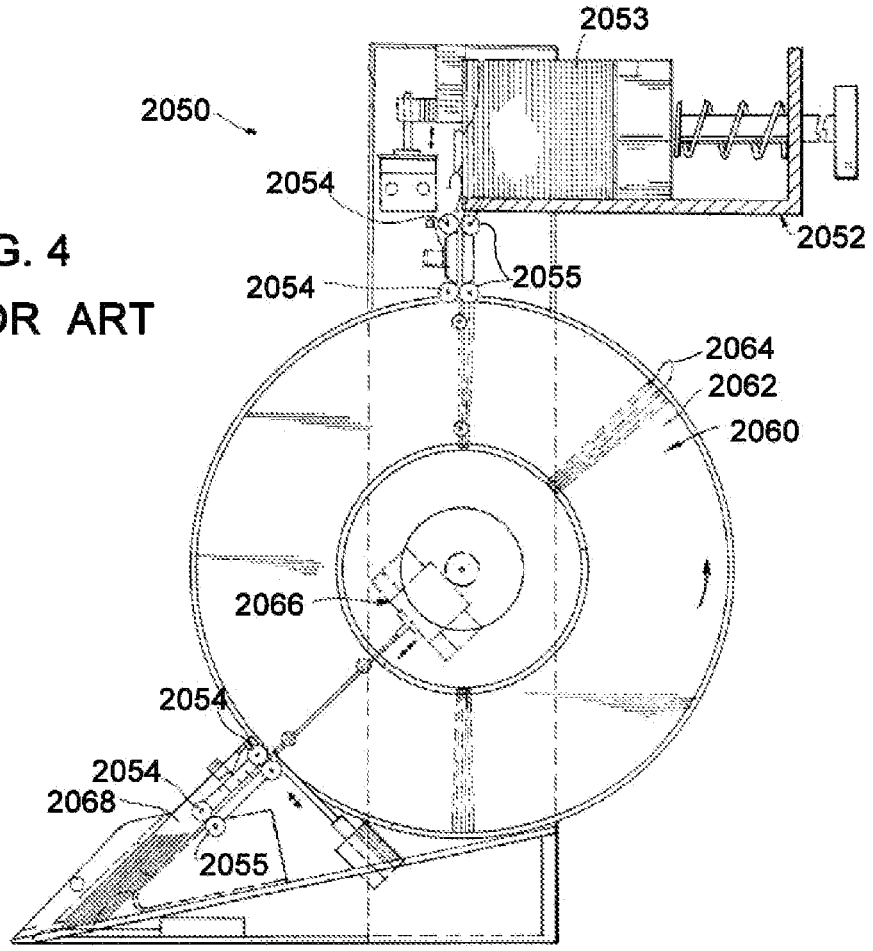
FIG. 4 PRIOR ART
FIG. 4 illustrates a classic prior art shuffling apparatus which unloads cards from an unshuffled deck into the individual slots of a carousel, randomly rotates the carousel, and then unloads cards from a randomly-chosen slot and into a discharge portal.
Figure 5:
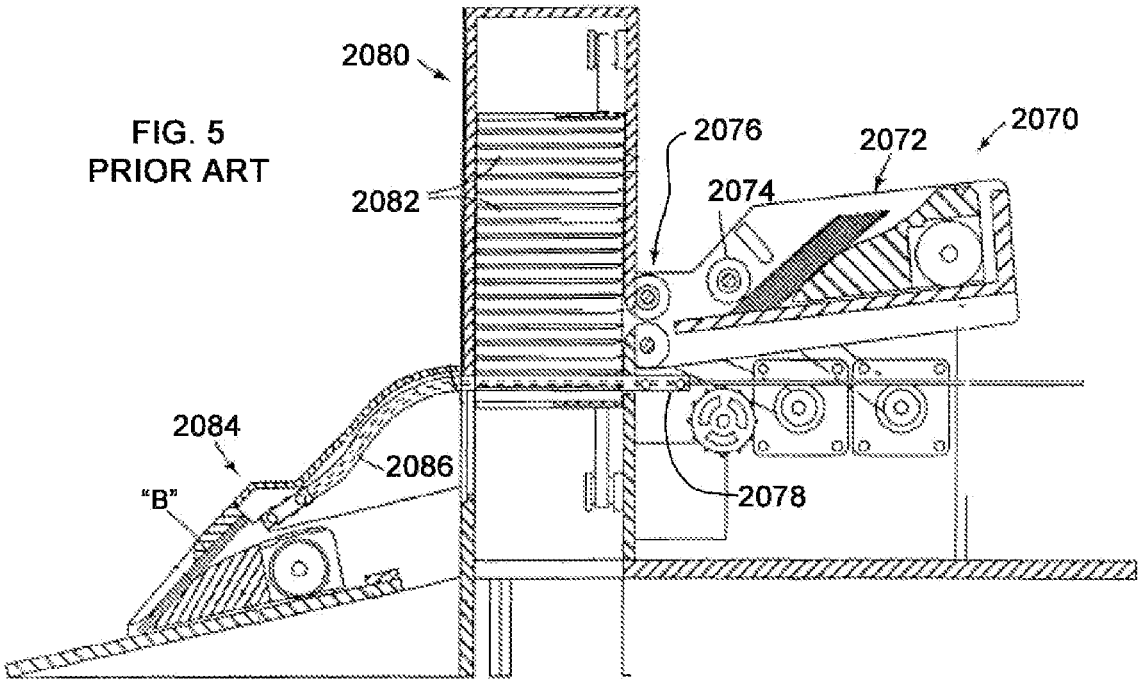
FIG. 5 PRIOR ART
FIG. 5 illustrates a similar prior art shuffling machine which unloads cards from an unshuffled deck into the individual slots of a vertical rack, randomly elevates the vertical rack, and then unloads cards from each slot and into a discharge portal.
Figure 6:
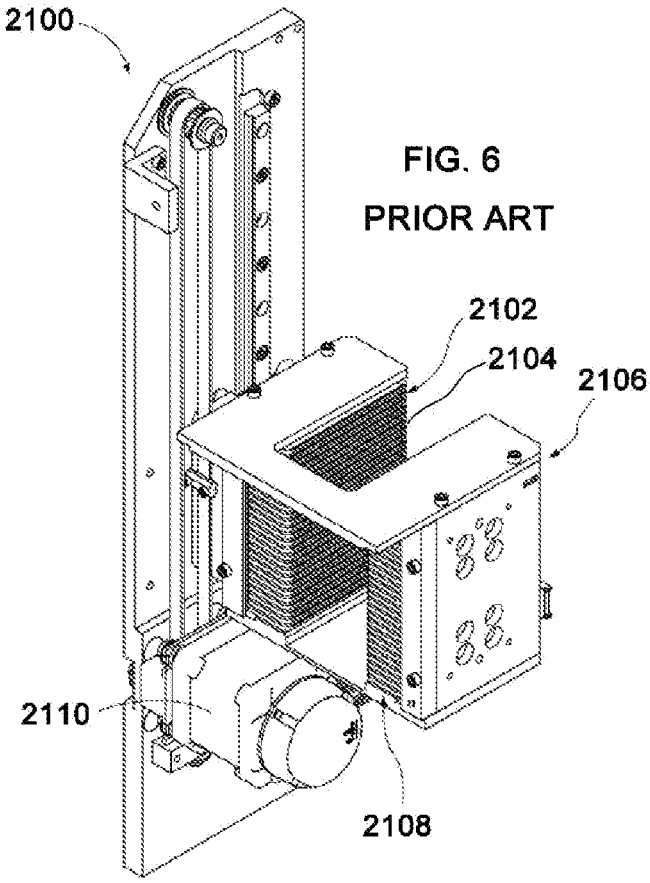
FIG. 6 PRIOR ART
FIG. 6 illustrates a prior art randomizing mechanism which utilizes a vertically moving comb with narrow card slots.
Figure 7:
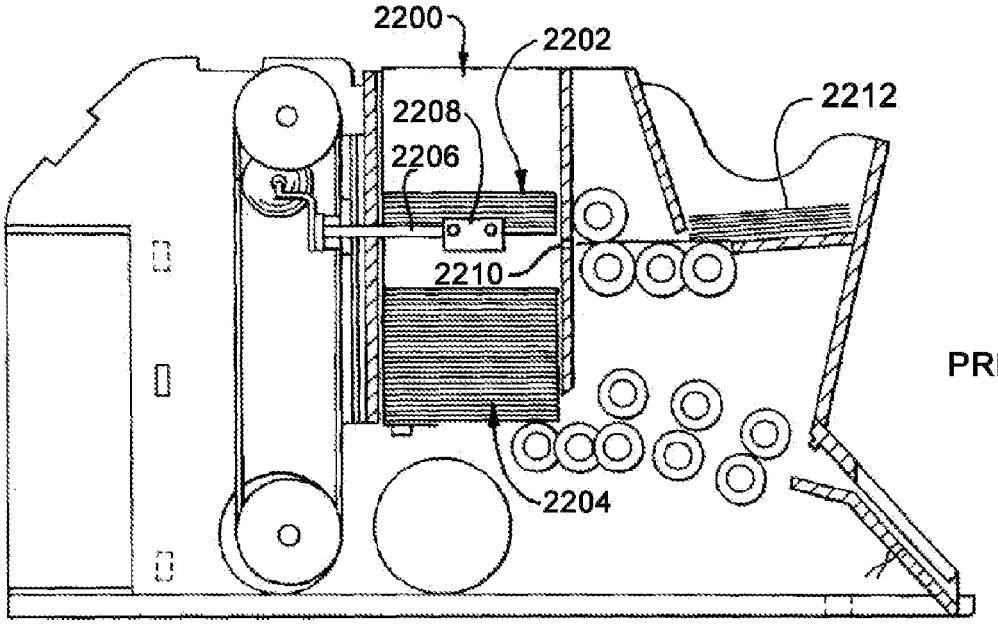
FIG. 7 PRIOR ART
FIG. 7 illustrates a prior art randomizing mechanism which utilizes a mechanical gripper to separate a card stack at random positions, thus enabling the insertion of an individual card which is being moved from an unshuffled deck residing within an intake portal.
Figure 8A:
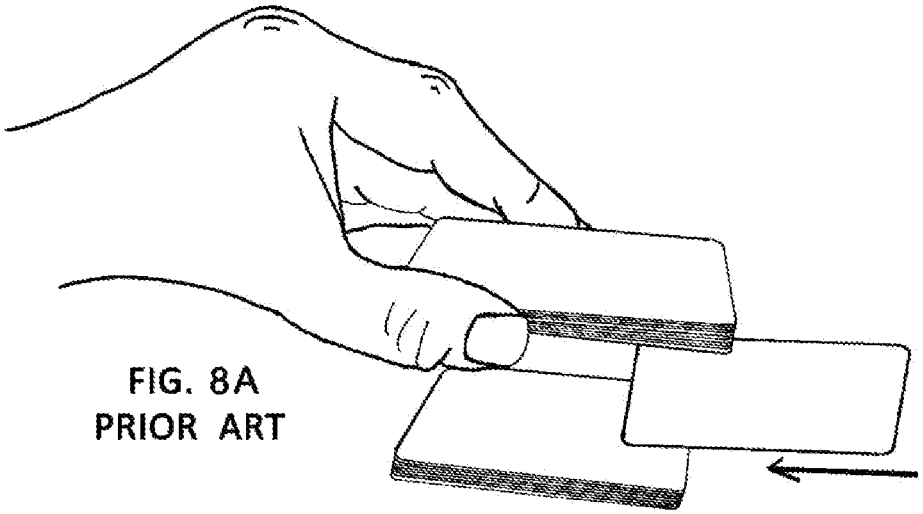
FIG. 8A PRIOR ART
FIG. 8A illustrates the insertion of a "cut card" into a card stack by a dealer, which is emulated by the prior art mechanical gripper mechanism of FIG. 7.
Figure 8B:
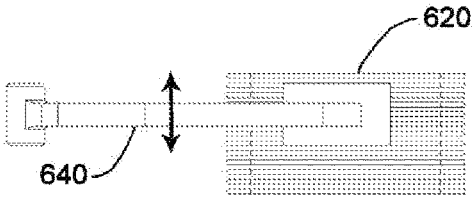
FIG. 8B PRIOR ART
FIGS. 8B and 8C illustrate a first method of splitting a card stack with a gripper and inserting a card as taught by the prior art.
Figure 8C:
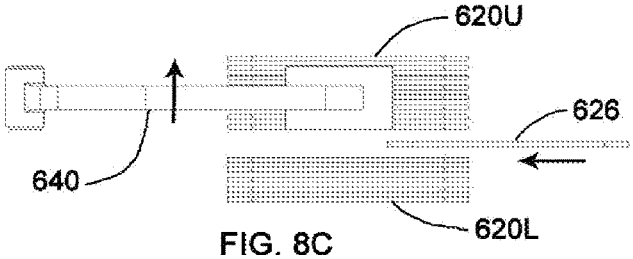
FIG. 8C PRIOR ART
Figure 8D:
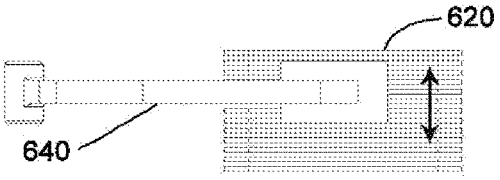
FIG. 8D PRIOR ART
FIGS. 8D and 8E illustrate a second method of splitting a card stack with a gripper and inserting a card as taught by the prior art.
Figure 8E:
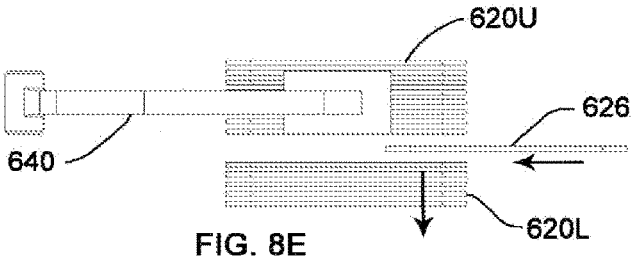
FIG. 8E PRIOR ART

The purpose of the cam 220 is twofold. Firstly, it is designed to create a large wedge-shaped opening 326 for insertion of an unshuffled card that can accommodate bent or warped cards as illustrated by the warped card 622 in FIG. 18. The large wedge-shaped opening 326 overcomes the jamming problem exhibited by narrow slot carousel and prior art comb shuffling devices shown in FIG. 4, FIG. 5 and FIG. 6. Secondly, the cam 220 is designed to alleviate the cyclic life burden on the components of the elevator assembly 300. The prior art devices that utilized gripper mechanisms (see prior art FIGS. 8B-8E) required three elevator motions for each card insertion: a first elevator motion to arrive at the splitting plane; a second elevator motion to split the deck into two sub-stacks; and a third elevator motion to merge the two sub-stacks together after each card insertion. For one deck of 52 cards, for example, the prior art elevators must shuttle through 156 (3×52) motion cycles. In contrast, the elevator assembly 300 of an embodiment of the present invention herein shuttles just once during each card insertion cycle, thereby extending the service life of the elevator assembly 300 as compared to the prior art.

The previously described grasp-elevate-insert-release cycle is repeated for each of the cards in an unshuffled deck until all cards have been transferred to the card stack 620 in the randomizing chamber 186. The card stack 620 thus begins with one card and builds to a full deck of 52 cards in the case that 52 cards is the desired deck size. Each new card is inserted into the card stack 620 at randomly-chosen vertical positions by the microcontroller, which utilizes a depletion algorithm in real time to determine a plane between two adjacent cards within the receiving card stack 620.

The depletion algorithm is based upon a physically-generated index that is derived from the optical recognition sensor 196. That optical recognition sensor 196 detects the trailing edge of each card and triggers the controller to increment a count that indicates the number of cards that have been depleted from the card intake portal 120. The depletion count is a physically detected index that is used by the randomizing algorithm. The algorithm can be expressed as equation 1.1:

$$P=\text{RAND}[1 \text{ to } D] \tag{1.1}$$

Where:

P=the vertical insertion plane, and

D=the depletion number of the card being inserted, and

RAND[1 to D] is a random number from within the range between 1 and D

Figure 29A:
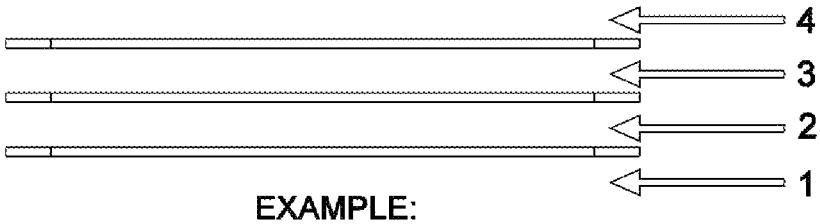

Equation 1.1 can be understood and appreciated from viewing the examples in FIG. 29A and FIG. 29B where the numbered arrows indicate optional plane locations within a card stack. In FIG. 29A, the depleted card number is 4, which means that this is the 4th card to be removed (depleted) from the unshuffled card stack. The microcontroller will chose a plane for inserting that 4th card into the previous 3-card stack, by generating a random number in the range of 1 to 4, where the bottom of the stack is always designated as plane number 1. In other words, the microcontroller randomly chooses one of four available planes for the insertion in real time. The elevator assembly 300 then positions the stack precisely such that the gripper pads 202 can create the wedge-shaped opening 326 at the chosen plane. The card is thereafter inserted into the wedge-shaped opening 326.

In FIG. 29B, the depleted card number is 9, which means that this is the 9th card to be removed (depleted) from the unshuffled card stack. The microcontroller will chose a plane for inserting that 9th card into the previous 8-card stack, by generating a random number in the range of 1 to 9, where the bottom of the stack is always designated as plane number 1. In other words, the microcontroller randomly chooses one of nine available planes for the insertion in real time. The elevator then positions the stack precisely such that the gripper pads 202 can create the wedge-shaped opening 326 at the chosen plane, insert a new card, and thereafter lower than the upper sub-stack 620U onto the newly inserted card. In this way, the randomized stack is incrementally constructed.

There is no preconceived boundary for the randomizing algorithm of equation 1.1, which depends only upon the physically detected depletion count. For example, a 65th depleted card would be randomly inserted in one of 65 randomly selected planes. This type of randomization is mathematically ideal randomization, because each and every card is randomly inserted into a growing randomly-generated card stack in real time, until the entire deck is transformed into a randomly distributed sequence. This is in contrast to several prior art shufflers that generate a virtual random insertion sequence prior to physically moving any cards.

Figure 22:
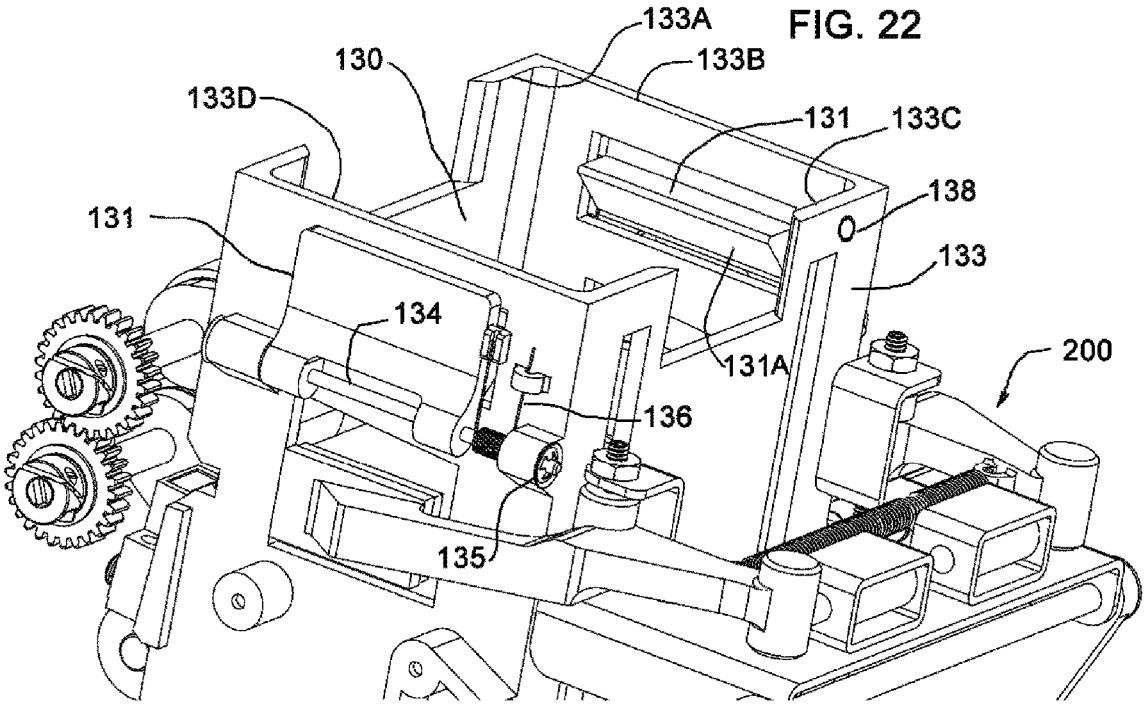
FIG. 22 is an isometric view of a retractable support structure within the card deck discharge portal.
Figure 23:
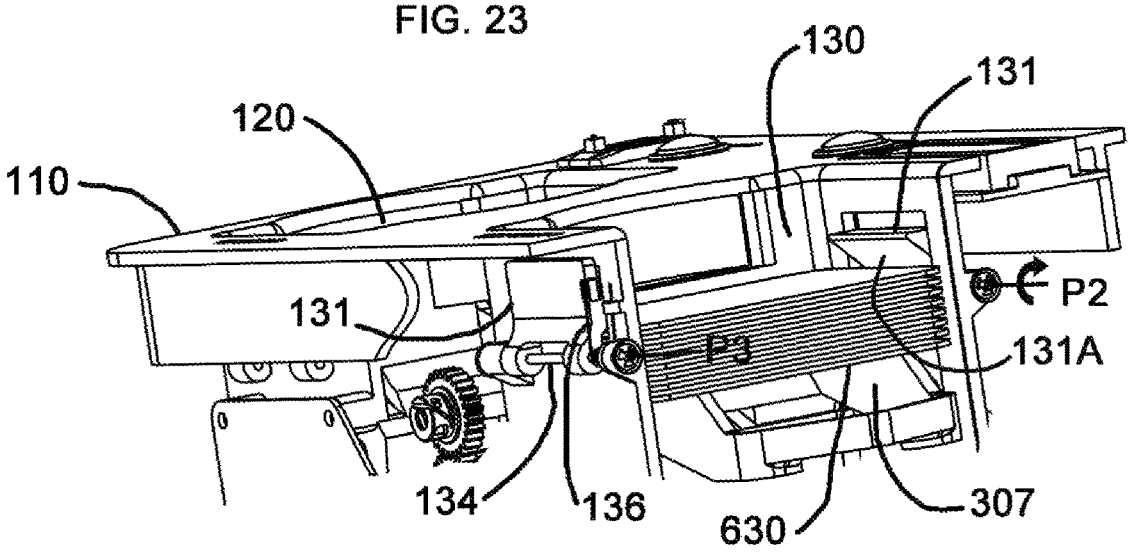
FIG. 23 is a cutaway isometric view showing the processed card stack being raised to the card deck discharge portal.
Figure 24A:
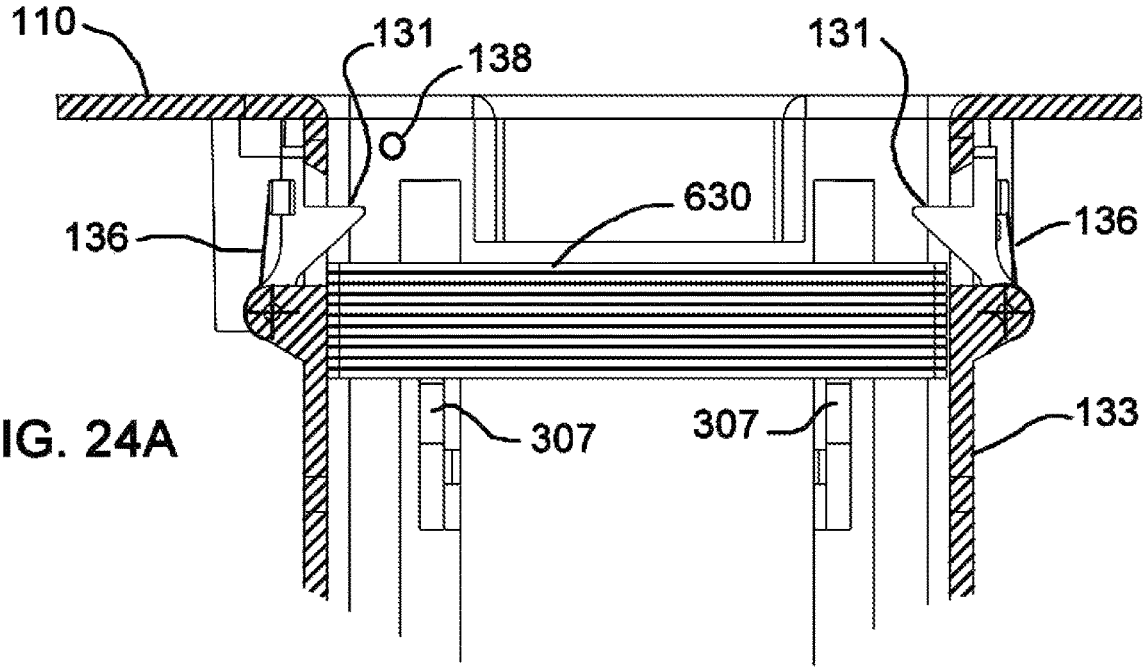
FIGS. 24A, 24B, 24C and 24D are step wise illustrations showing the sequence used to transfer a "reserve deck" from the elevator to the retractable support structure of the preferred embodiment.
Figure 24B:
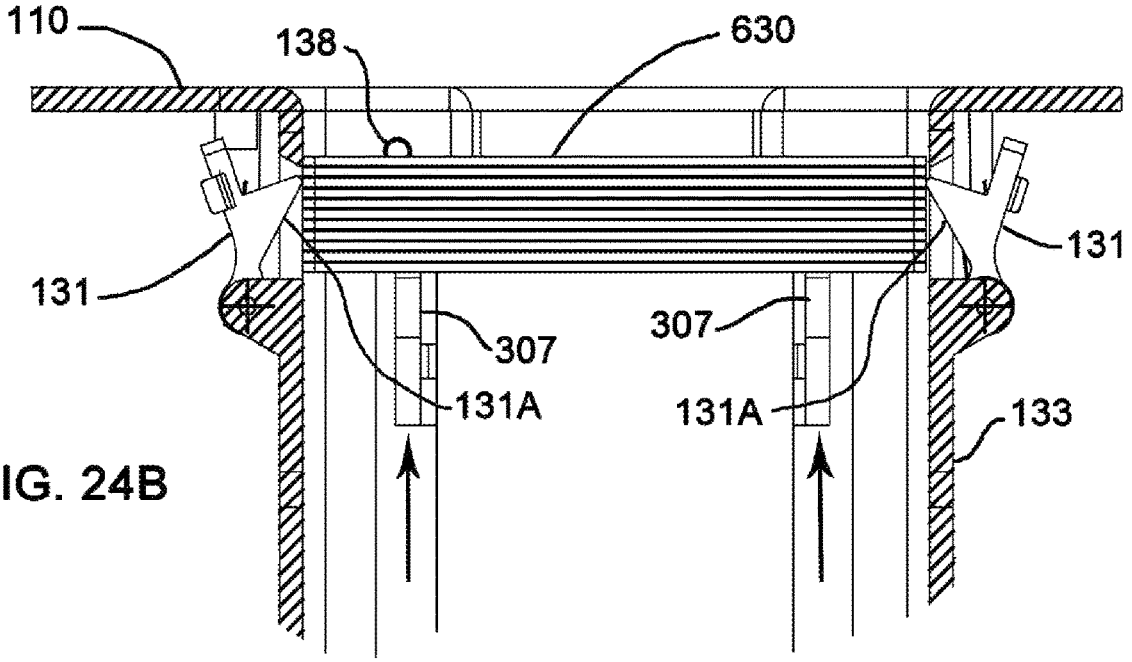
Figure 24C:
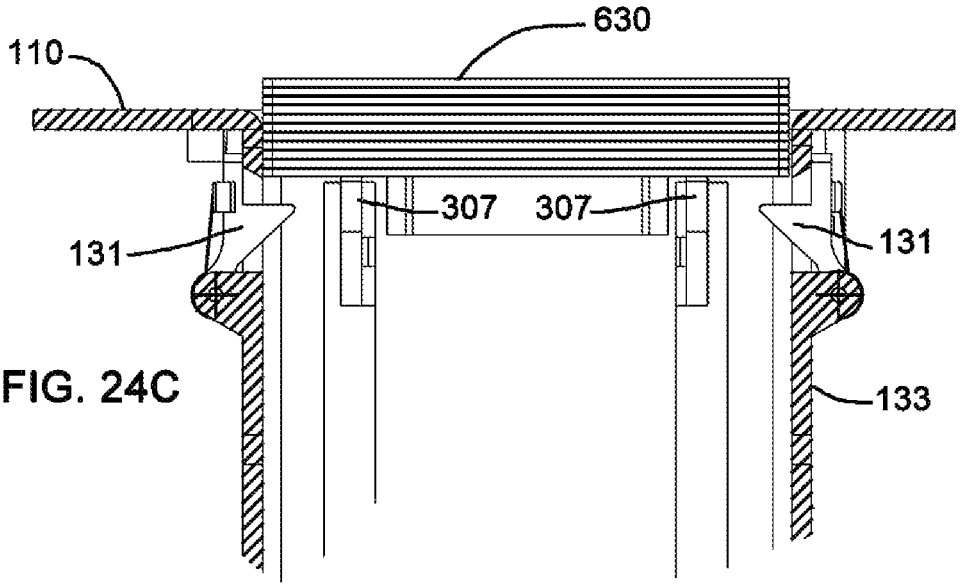
Figure 24D:
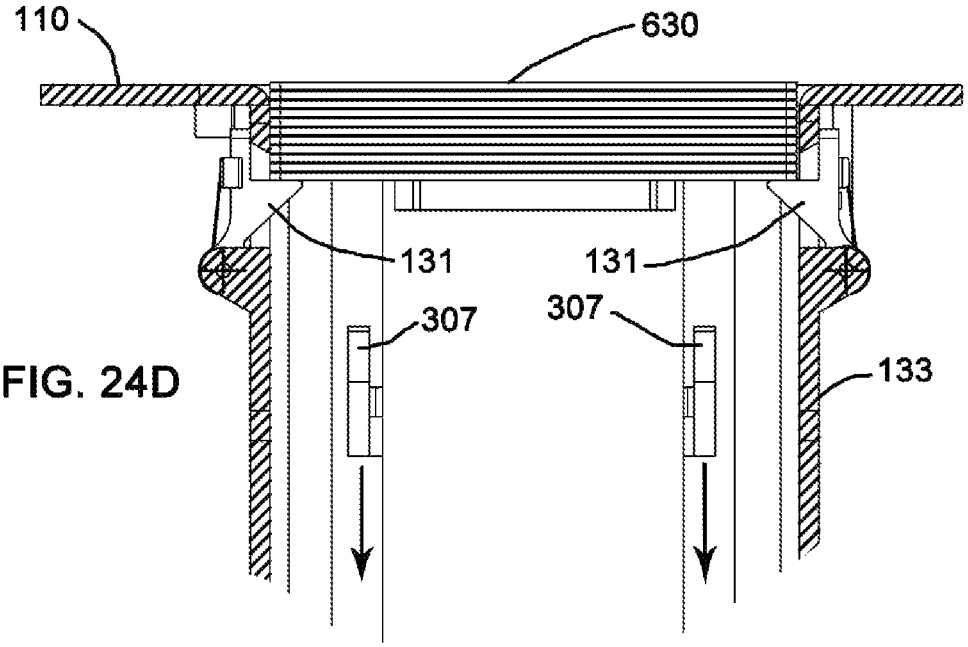

After completion of the randomizing cycle, the elevator arms 307 raise the processed card deck 630 to the card deck discharge portal 130, where the processed card deck 630 is transferred to a retractable support structure as shown in FIG. 12B. A preferred embodiment for the retractable support structure is shown by the retractable support elements or shutters 131 in FIG. 12B, FIG. 21 and FIG. 22. Referring to FIG. 22, a pair of shutters 131 are rotatably mounted to the walls of the housing 133 and rotate upon pivot shafts 134, which are held in a supporting position by torsion springs 136. Referring to FIG. 23, the two pivot shafts 134 form axes P2 and P3, about which the shutters 131 rotate. As the elevator arms 307 raise the processed card deck 630 towards the card deck discharge portal 130, the processed card deck 630 pushes against angular surfaces 131A on the underside of the shutters 131, forcing them outward. FIG. 23 shows a cutaway oblique view of a processed card deck 630 being raised by the elevator arms 307 and located just beneath the angular surface 131*a* of shutters 131. The card deck 630 is just about to collapse the shutters 131 in this illustration. FIGS. 24A, 24B, 24C, and 24D illustrate side elevational section views which explain the sequence of collapsing the retractable support elements or shutters 131. In FIG. 24A, a processed card deck 630 is shown in the "reserve deck" position and the "ready deck" has just been removed. The state change of sensor 138 signals the absence of the "ready deck" and triggers the microcontroller to examine the incremental encoder count of the incremental encoder 310, which shows that the elevator arms 307 being held in the "reserve deck" position. The microcontroller thus commands the elevator motor 312 to raise the processed card deck 630 to the card deck discharge portal 130. Referring to FIG. 24B, as the elevator arms 307 raise the processed card deck 630, the retractable supports 131 are pivoted outwardly away by contact between the angular surfaces 131A and the lateral surfaces of the deck 630. FIG. 24C shows that the processed card deck 630 is raised slightly above the retractable supports 131, allowing them to snap back into position as urged by torsion springs 136. In FIG. 24D, the elevator arms 307 have transferred the processed card deck 630 to the retractable supports 131, and the elevator arms 307 continue moving downward. The elevator arms 307 thus transfer the processed card deck 630 from the elevator arms 307 to the retractable supports 131 by a downward motion. The elevator arms 307 are thereafter available to participate in randomizing additional card decks within the lower portion of randomizing chamber 186.

Figure 25A:
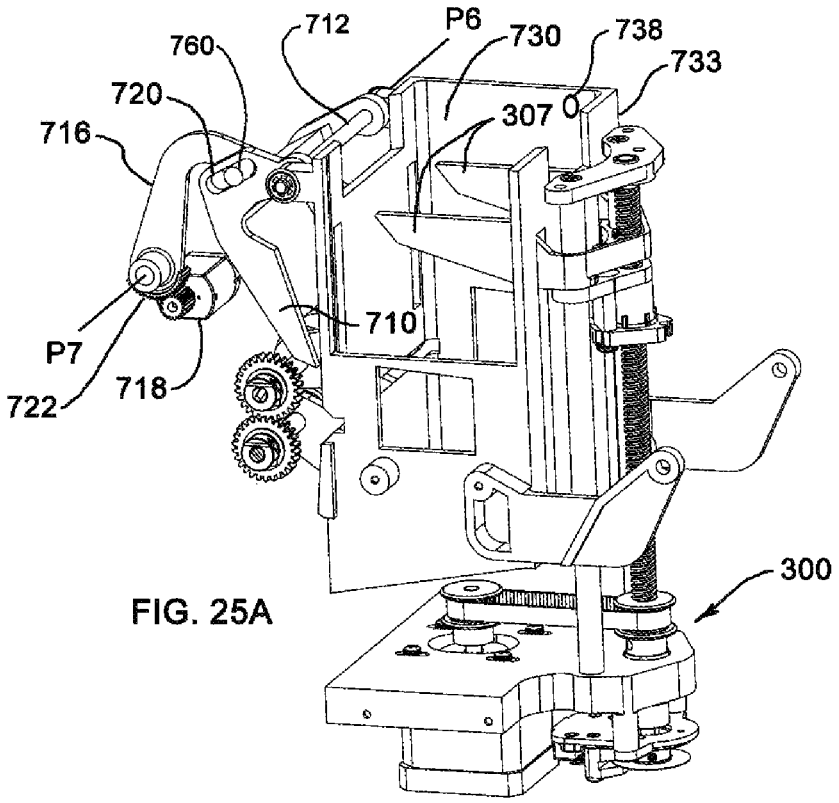
FIGS. 25A, 25B, and 25C are cutaway isometric views showing a sequence of operations performed by a first alternate embodiment of a retractable support structure in the card deck discharge portal in the absence of a card deck.
Figure 25B:
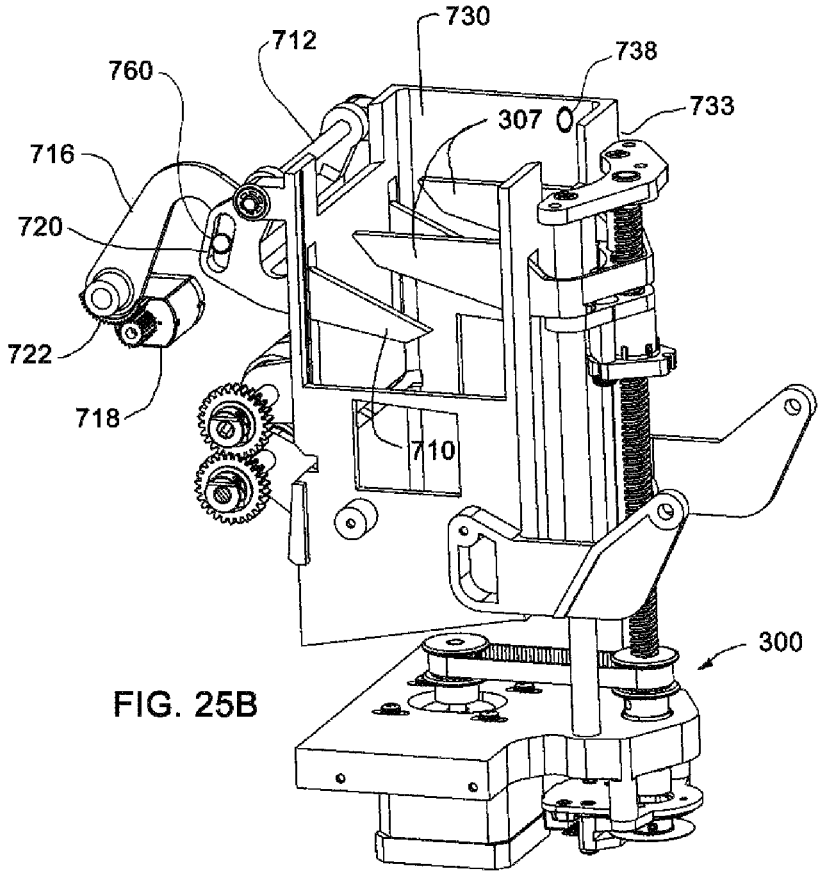
Figure 25C:
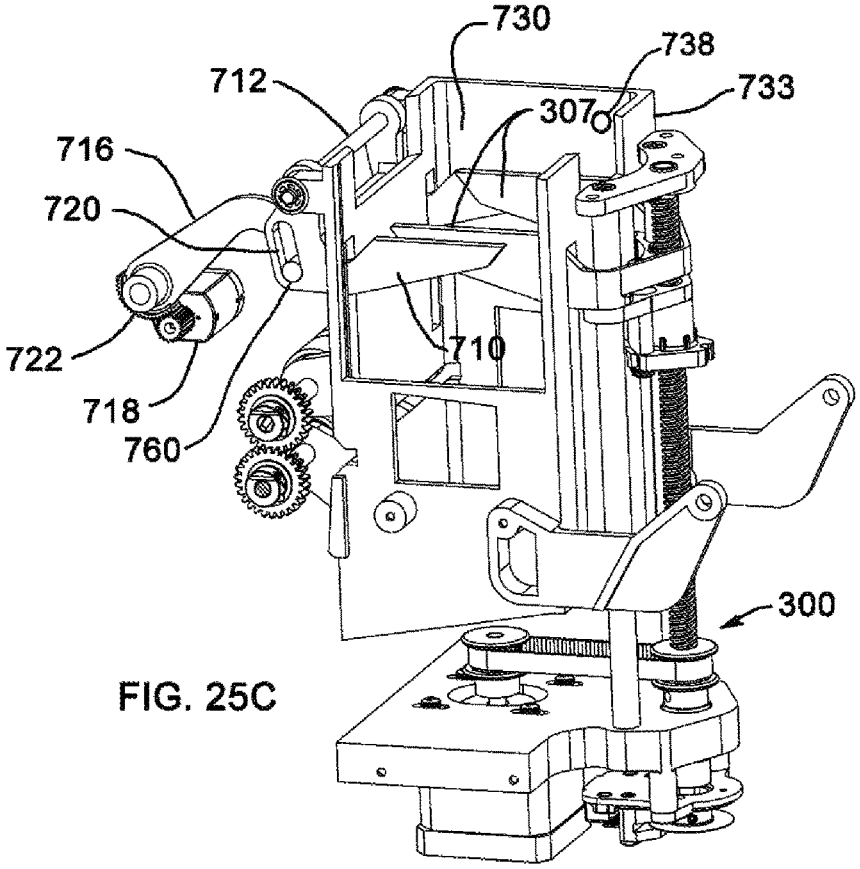

An alternate embodiment of the retractable support structure is illustrated in FIGS. 25A, and 25C where a cutaway window is illustrated in the wall of the housing 733. FIGS. 25A, and 25C illustrate the sequence of operation of a motorized retractable support structure without the presence of playing cards so that the viewer can visualize the interaction of the card support surfaces. This embodiment utilizes a DC motor 718 and a fork-shaped support 710 to support the processed card deck in the card deck discharge portal 730. FIG. 25A shows the retractable support arms 710 which pivot on shaft 712. In this figure, the support arms 710 are located in the retracted state outside of the randomizing chamber 186 where they remain during the randomizing cycle. Reflective sensor 738 is mounted in the wall of the deck discharge portal 730 for the purpose of sensing the presence of a deck of cards (the "ready deck"). A bellcrank 716 pivots upon axis P7 and possesses a segment gear 722 which is in mesh with the pinion on DC motor 718. Actuation of the DC motor 718 causes rotation of bellcrank 716, which in turn imparts rotation upon support arms 710 which pivot upon axis P6. In FIG. 25B, the retractable support arms 710 have partially rotated into the randomizing chamber 186 through slots in the wall of housing 733, but have not reached its zenith position. The motion is created by the rotation of bellcrank 716, which possesses gear segment 722 that meshes with the pinion of DC motor 718. A pin 760 on the terminal end of bellcrank 716 engages with a slot 720 in the retractable support arms 710 to rotate them about their pivot shaft 712. The retractable support arms 710 have completed their upward motion in FIG. 25C whereupon the retractable support arms 710 are located at an elevation level just above or coincident with the support surfaces 307A of elevator 307 within the card deck discharge portal 730. The retractable support arms 710 are shown located width-wise outside of the elevator arms 307 in this embodiment, but the elevator arms 307 could instead be located outside of the retractable support arms 710.

Figure 26A:
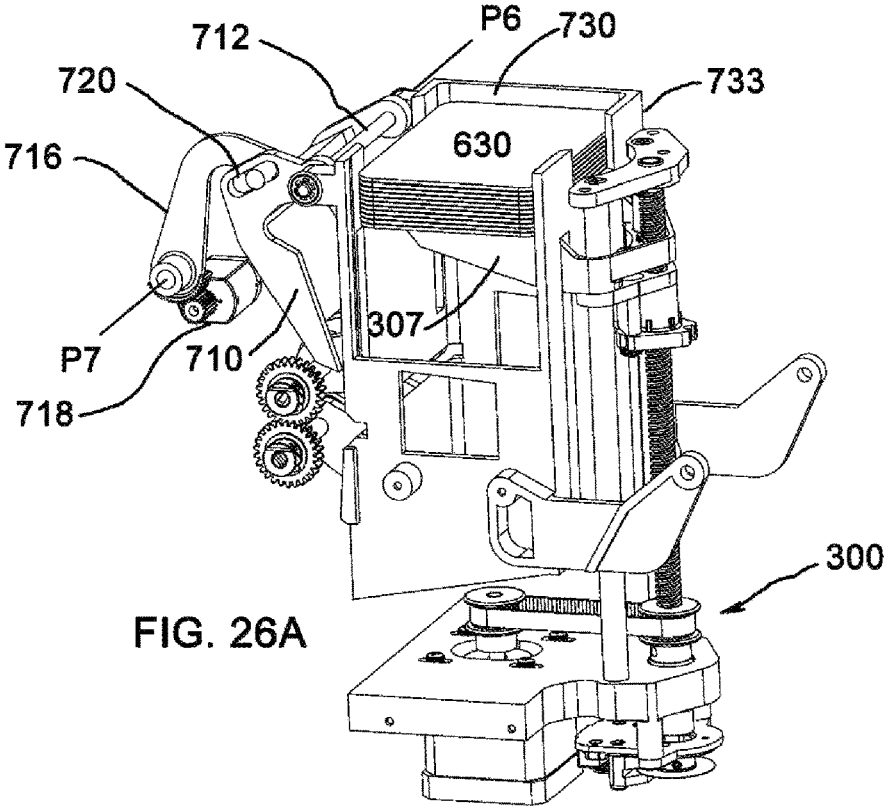
FIGS. 26A, 26B and 26C show a sequence of operations performed by a first alternate embodiment of a retractable support structure in the card deck discharge portal when transferring a card deck from the elevator to the retractable support structure.
Figure 26B:
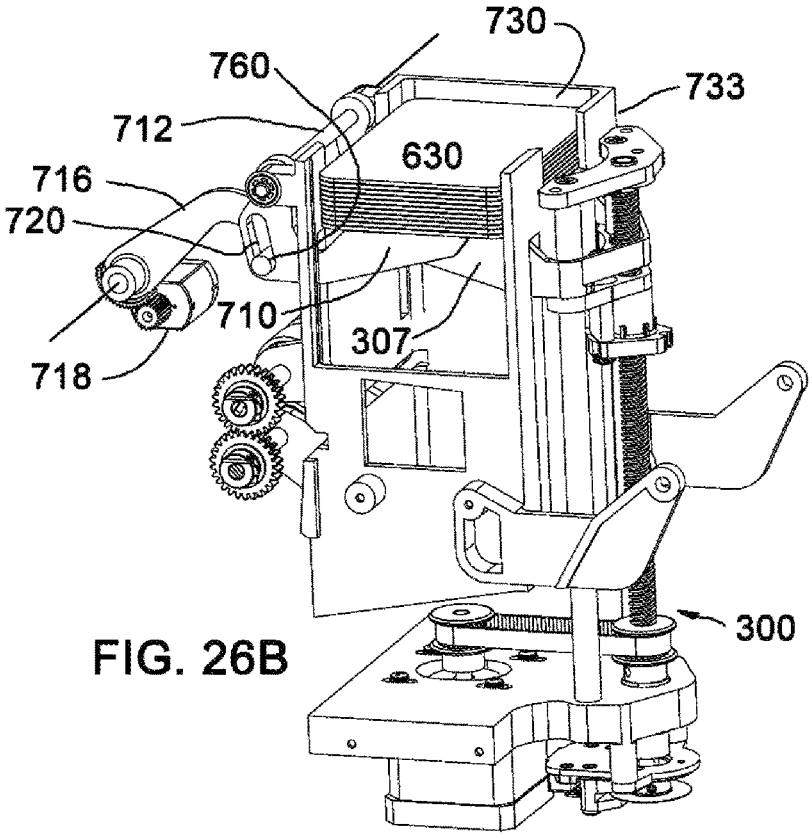
Figure 26C:
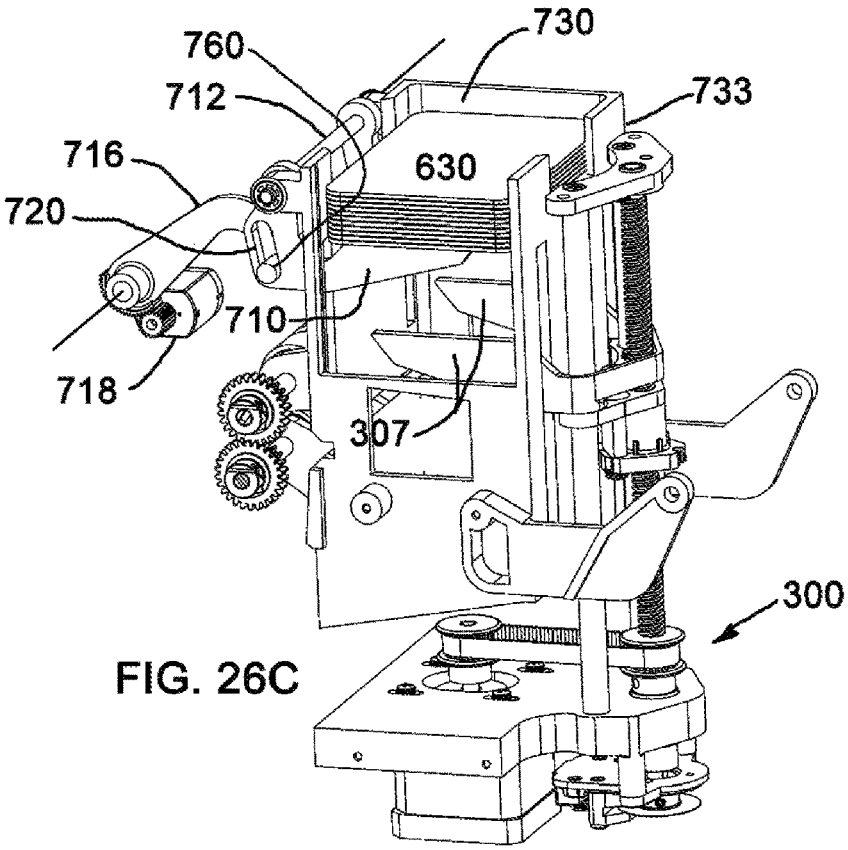

FIGS. 26A, 26B, and 26C show the same sequence of mechanism movement as the previous sequence but adding in the processed card deck 630 to these views. In FIG. 26A, the randomizing cycle has been completed and the processed card deck 630 has been raised to the card deck discharge portal 730, where it is temporarily supported by the elevator arms 307. The retractable support arms 710 remain outside of the randomizing chamber 186 until the elevator arms 307 reaches its zenith. In FIG. 26B, the retractable support arms 710 have been rotated into the orientation where the bellcrank has captured the processed card deck 630 from the elevator arms 307. In FIG. 26C, the elevator arms 307 are shown moving downward after the processed card deck 630 has been transferred to the retractable support arms 710 within the card deck discharge portal 730. In this embodiment, the elevator arm zenith is slightly below the ultimate level of the retractable supports 710, such that the processed card deck 630 is raised slightly by the retractable support arms 710 as they swing upward into position. Transfer of the processed card deck 630 to the retractable support arms 710 is thus induced by upward motion of the retractable support arms 710 in this embodiment.

Figure 27A:
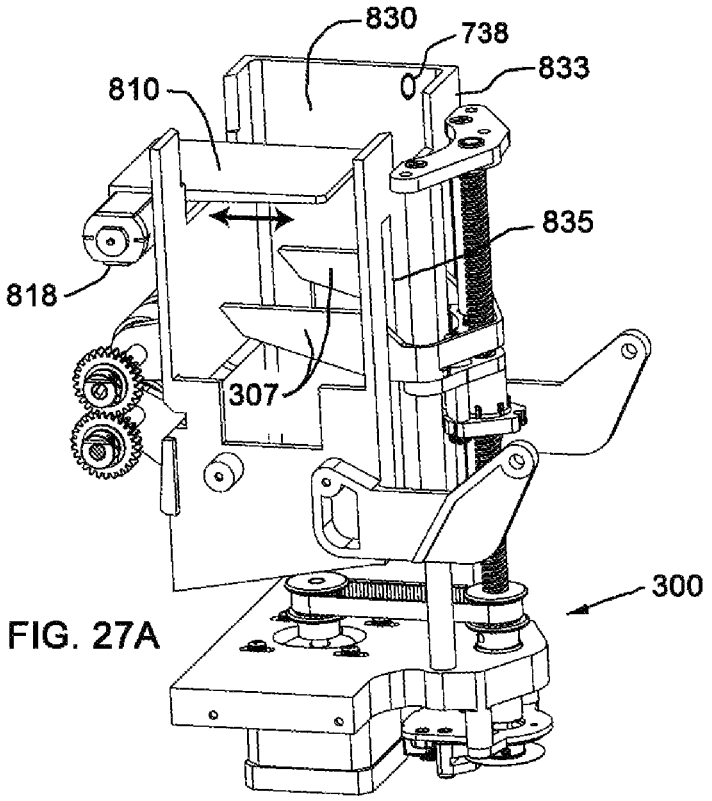
FIG. 27A is a cutaway view showing a second alternate embodiment of a retractable support structure that positions a play ready card deck in the card deck discharge portal.

A third embodiment of a retractable support structure for the card deck discharge portal is shown in FIG. 27A. In this embodiment, a blade-like retractable support 810 is retracted in planar fashion (see arrows) by a DC motor 818 via a pinion and a rack which is located on the underside of the blade (not shown). The blade-like retractable support 810 is normally retracted from the interior of the housing 833 during randomization. When randomization is completed, the elevator arms 307 raise the processed card deck 630 to a level just above the height of the blade-like retractable support 810. Thereafter, the blade-like retractable support 810 is injected into the card deck discharge portal 830 and the elevator arms 307 lower the processed card deck 630 onto the blade-like retractable support 810. The elevator arms 307 are then lowered to a position where randomization of another deck of cards can commence. In this embodiment, transfer of the processed card deck 630 to the blade-like retractable support 810 is induced by downward motion of the elevator arms 307.

Figure 27B:
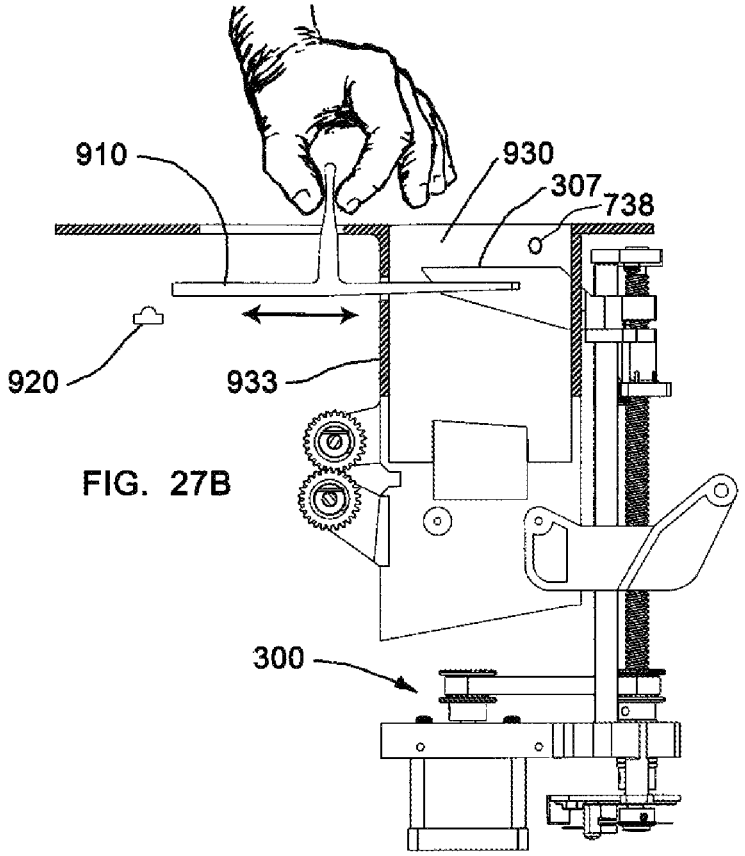
FIG. 27B is a cutaway view showing a third alternate embodiment of a retractable support structure that positions a play-ready card deck in the card deck discharge portal.

A fourth embodiment of the retractable support structure utilizes a non-motorized blade-like retractable support element 910 as shown in FIG. 27B. In this embodiment, the dealer slides a retractable support element 910 into place after the elevator arms 307 have completed the upward movement to the card deck discharge portal 930. The plane of the retractable support element 910 is slightly lower than the elevator support arms 307 such that the processed card deck 630 will be transferred to the retractable support element 910 when the elevator arms are lowered. If the dealer wants to process a "Reserve Deck" while a "Ready Deck" is held in the card deck discharge portal 930, then the dealer can manually slide the retractable support element 910 into the position shown in FIG. 27B. The manual movement of the retractable support element 910 is detected by a reflective sensor 920 which is utilized by the microcontroller to monitor the position of the retractable support element 910. As the retractable support element 910 is slid rightward relative to the housing 933, the reflective sensor 920 will be triggered by lost reflectance, thus signaling the microcontroller to lower the elevator arms 307 to where the elevator arms 307 can participate in randomizing another card deck. As the elevator arms 307 are lowered, the processed card deck 630 is transferred to the retractable support 910.

Termination of the randomizing cycle is detected by the microcontroller via sensor 129 (FIG. 12A). Upon termination of the randomizing cycle, the microcontroller will check the status of the sensor 138 (FIGS. 24A & 24B) which detects presence of a "ready deck". If no "ready deck" is detected, the microcontroller will commence the cycle of transferring the processed card deck to the retractable supports 131 in the card deck discharge portal 130. If a "ready deck" is present, then the microcontroller will command the elevator arms 307 to move to the footprint position and hold the processed card deck 630 (2) in the "reserve deck" position as shown in FIG. 30. The microcontroller detects the presence of a processed card deck 630(2) in the "reserve deck" position by utilizing the cumulative count of the incremental encoder 310 which keeps track of the elevator arm 307 height in terms of encoder register counts. For example, an encoder count of 3490 represents the elevator arm 307 height at the footprint position, and an encoder count of 5340 represents the zenith of the elevator arms 307 just prior to transferring a processed card deck 630 to the retractable support structure 131. If the microcontroller detects that the elevator arms 307 are stationed at the "reserve deck" position, then no action will be taken when a card deck is inserted at the card intake portal 120.

The astute casino card dealer will utilize the apparatus 100 of the present invention to sustain the rate of table play by maintaining a three-deck rotation as illustrated by the preferred embodiment shown in FIG. 30. This figure illustrates the configuration of the apparatus 100 as properly prepared by the dealer at the start of a card game or beginning of a shift. In this figure, the dealer has just inserted a new deck 600 into the card intake portal 120. The "ready deck" 630(1) resides in the card deck discharge portal 130 as supported by the retractable supports 131 and the "reserve deck" 630(2) resides in the footprint position as supported by the elevator arms 307. While placing the spent deck 600 into the card intake portal 120, the dealer will the observe the status indicators 116 and 117 (FIG. 10) to discern if either the "ready deck" or the "reserve deck" is faulty.

If no faults are indicated, the dealer removes the "ready deck" 630(1) to the table and starts or continues game play. Thereafter, the apparatus 100 responds automatically. The removal of the "ready deck" changes the state of sensor 138 (FIG. 22) and triggers the microcontroller to move the "reserve deck" 630(2) upward and transfer that deck to retractable supports 131. The "reserve deck" 630(2) then becomes the "ready deck" 630(1) and the elevator arms 307 thereafter move downward to a position ready for randomizing another card deck.

The action of transferring the "reserve deck" 630(2) to the card deck discharge portal 130 also triggers the microcontroller to interrogate the condition of the card intake portal 120 by checking the state of sensor 129 (FIG. 12A) and sensor 138 (FIG. 22). When sensor 129 detects the presence of a card, then the apparatus 100 will commence the processing cycle by verifying and randomizing the previously spent deck. When that randomizing cycle is completed, the elevator arms 307 will raise the processed deck to the footprint position (see position of cards 630(2) as shown in FIG. 30).

Normally, the dealer will not encounter a faulty "ready deck" because the dealer had previously "looked ahead" to the status of the "reserve deck" while having removed the previous "ready deck". If having observed a faulty "reserve deck" via status indicator 116, the dealer will remove the "ready deck" to the playing table surface for play, and thereafter wait a few seconds for the apparatus to elevate the "reserve deck" to the card deck discharge portal 130. The dealer can then discard the faulty "reserve deck" or take whatever other action is mandated by casino policy.

In the event that a faulty deck needs to be removed, the normal three-deck rotation will be disturbed, leaving only two decks. The dealer can remedy that situation by adding a new deck in between hands of his card game after observing an audible alarm from the shuffling apparatus 100.

When the faulty "reserve deck" is being removed from the card deck discharge portal 130, the "ready deck" will have been removed to the playing table and a new deck or previously spent deck will have been placed into the card intake portal 120. After activating the SHUFFLE button 115, the previously spent deck will be randomized and transferred to the card deck discharge portal 130 as the "ready deck", because no "reserve deck" is present. At that time, the card intake portal 120 will be vacant and the microcontroller will signal this condition to the dealer with a subtle audible tone. During the interval between hands, the dealer may then take remedial action to restore the three-deck rotation by introducing a new deck 600 into the card intake portal 120, and the apparatus 100 will process that deck automatically as explained above.

The apparatus 100 of the present invention is capable of facilitating a three-deck rotation which statistically guarantees less downtime attributable to the possibility of encountering faulty decks. With a three-deck rotation, three discrete, separate card decks 600, 630(1), 630(2) may reside within the apparatus 100 at any point in time. The three-deck rotation is illustrated in FIG. 30 where the "ready deck" 630(1) is shown in the card deck discharge portal 130 and the "reserve deck" 630(2) is shown in the footprint position as supported by the elevator arms 307. When the dealer removes the "ready deck"630(1) in FIG. 30, the remaining two decks 630(2), 600 will advance through the apparatus 100 automatically and the card intake portal 120 will become vacant.

The apparatus 100 herein can be utilized as a device to verify the integrity of card decks without randomizing the cards. The "verify-only" mode can be set by utilizing the push switch selector 111 on the apparatus console 105 as shown in FIG. 10. As shown in FIG. 12A, the unshuffled cards 600 may be fed past the optical recognition sensor 196 and stacked upon the elevator arms 307 within the randomizing chamber 186 without randomizing. The interrogated card deck is then transferred to the card deck discharge portal 130 as shown in FIG. 12B. If that card deck has been verified without error, then the "Ready Deck" indicator light 107 on the console 105 will be activated with green color (see FIG. 10). The time for processing a card deck in the "verify-only" mode will be somewhat shorter because no randomization cycle is needed.

During the verification only mode, the elevator surfaces 307 do not relocate for each and every card insertion cycle. Instead, the elevator surfaces 307 are incrementally moved downward by the elevator mechanism 300 to accommodate the increasing thickness of the stack 620 that accumulates upon the elevator support surface (see FIG. 14). After each group of 13 cards accumulates on the elevator 307, the elevator is lowered by an amount equal to the thickness of 13 cards. This stack settling cycle is nominally performed four times during the verification of a 52-card deck. The number of cards in the stack settling cycle (13) may be modified as appropriate. The number could be as little as one, but that choice may be considered impractical by the designer of the apparatus.

Also, during the verification only mode, the cam-controlled platform 210 is cycled for each and every card insertion cycle (see FIG. 15). However, the solenoids 207 and 208 that acuate gripper arms 203 and 204 are only actuated during specific insertion cycles. Prior to each incremental stack settling cycle of the elevator 307, the cam-controlled gripper arms 203 and 204 are also actuated by solenoids 207 and 208 so as to remove accumulated trapped air from within the growing stack 620. This gripper cycle takes place just prior to each of the incremental stack settling cycles of the elevator 307. The elevator 307 moves each accumulated stack to an elevation where the gripper arms 203 and 204 may grasp the bottom of the stack 620, and the gripper arms thereafter actuated by the solenoids 207 and 208. The cam-controlled gripper mechanism 200 then raises the accumulated stack 620 and thereafter releases it, allowing the accumulated stack 620 to free fall upon the elevator surface 307 to remove accumulated air from the stack. Both the elevator mechanism 300 and the gripper arms 203 and 204 are actuated during these stack settling cycles in the verification only mode.

The relational geometry as shown in the figures is not limiting. For example, the axis formed by the lateral walls 133 of the randomizing chamber 186 as shown in FIG. 12A may form an oblique non-perpendicular angle with the surface of the casino table. The planes which define the openings of the card intake portal 120 and the card discharge portal 130 may be offset vertically from each other or form acute angles with the surface of the casino table. The rectangular openings of the card intake portal 120 and the card discharge portal 130 may be non-parallel with any lateral surface of the apparatus housing. Furthermore, the axis of the shuffling chamber 186 shown in FIG. 12A is not limited to a perpendicular orientation with the card intake portal 120 and the card deck discharge portal 130.

Referring to FIG. 12A, the cards are transported by nip rollers 162, 164, 166, 168, and 169 in that figure. However, it is noted that the cards may be transported from the intake portal 120 to the randomizing chamber 186 by any other transport means that is known in the art. Also referring to that figure, it can be seen the optical recognition sensor 196 could also reside at the position of the card present sensor 129. Furthermore, the functions of the optical recognition sensor 196 and the card present sensor 129 could optionally be combined and reside at the position of sensor 129. Other sensor locations, other sensor types, and other optical recognition devices could be utilized as known and practiced in the art.

Referring to FIG. 9, various control means on the control panel are shown implemented as push switches, push buttons, indicator lights and a 2-line LCD display. However, any other control means, or combinations of control means could be implemented to perform the status awareness functions, as is well known and practiced in the art. Those controls could also be located in different geometric orientations than shown, as for example on a control surface that is elevated or angularly re-oriented away from the surface of the card intake and discharge portals. The control region could also be located on a lateral surface of the device housing in the alternative tabletop embodiment. Moreover, the control functions could be simplified and centralized by utilizing a touch screen display. The control panel could also be removable from the apparatus housing so as to be more conveniently located by an operator. The operation of the control panel and the apparatus could also be monitored remotely over a network by casino personal or a centralized server.

Referring to FIG. 13, the elevator arms 307 could be translated by devices other than the lead screw 304 and stepper motor 312. For example, toothed belts or rack and pinion gears could be utilized. Cable drives and different types of motors such as linear motors or servo motors could also be utilized, as well as any other elevator moving means and sensing means as known in the art.

Referring to FIG. 15 and FIG. 16, the gripper closing function of the solenoids 207 and 208 and the return function of spring 212, could be performed by a number of alternative moving mechanisms, including servos, toothed belt drives, geared drives, rotary solenoids or any other rotatable moving means as is known and practiced in the art.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A card handling apparatus for randomizing and/or verifying the integrity of at least a first individual deck of playing cards, the card handling apparatus comprising:

a housing adaptable to be mounted onto a surface of a casino table or into an opening within the surface of a casino playing table;

a card intake portal accessible by a dealer for receiving unshuffled cards;

a card deck discharge portal accessible by a dealer for receiving shuffled and properly verified cards from within the apparatus;

a control panel for indicating a status of at least the first individual deck of playing cards;

an optical recognition sensor configured to individually read a rank and a suit of each card within the playing cards of the card intake portal;

the housing defining a randomizing chamber and the card deck discharge portal, the housing having an opening for receiving each individual card of the first individual deck of playing cards from the intake portal;

one slot-less elevator aligned with the randomizing chamber having elevator arms movable along an axis of and within the randomizing chamber and configured to relocate once for each and every card of an unshuffled card deck during a randomizing cycle;

a retractable support structure located within the discharge portal, having a first position in which the retractable support structure projects into the discharge portal housing and a second position in which the retractable support structure is capable of moving through an opening in a wall of the discharge portal housing to achieve the first position;

a gripper mechanism located in the randomizing chamber and movable in an arcuate motion relative to the randomizing chamber axis;

at least one microcontroller for directing the verification and transport of the playing cards and providing status to a card handler operator; and wherein the microcontroller initiates a first randomizing cycle of the at least first individual deck of playing cards, such that individual cards of the at least first individual deck of cards from the card intake portal are interrogated by an optical recognition sensor and moved to the one slot-less elevator configured to locate every individual card of the at least first individual deck of cards from the card intake portal to randomize an order of the individual cards within the at least first individual deck of cards to provide a first shuffled and verified deck of cards, the first shuffled and verified deck of cards transferred from the elevator arms to the retractable support structure within the card deck discharge portal by the one slot-less elevator at completion of the first randomizing cycle.

2. The card handling apparatus of claim 1, wherein a second individual deck of playing cards is received within the card intake portal and the microcontroller initiates a second randomizing cycle of the second individual deck of playing cards, such that individual cards of the second individual deck of playing cards are interrogated by the optical recognition sensor and moved to the one slot-less elevator to provide a second shuffled and verified deck of cards, the second shuffled and verified deck of cards remaining supported upon the arms of the one slot-less elevator at completion of the second randomizing cycle and held in a position adjacent to the card discharge portal and the first individual deck of playing cards.

3. The card handling apparatus of claim 2, wherein removal of the first shuffled deck from the card discharge portal initiates the microcontroller to interrogate an encoder status of the slot-less elevator indicative of position of the slot-less elevator and for a presence of a second shuffled and verified deck of cards on the slot-less elevator.

4. The card handling apparatus of claim 3, wherein when the encoder status is indicative of the presence of the second shuffled deck of cards, the microcontroller initiating movement of the slot-less elevator to move the second shuffled deck of cards to the card discharge portal after the first shuffled deck of cards is removed from the card discharge portal.

5. The card handling apparatus of claim 1, wherein actuation of the retractable support structure is dependent only upon the relative position of the slot-less elevator.

6. The card handling apparatus of claim 5, wherein the retractable support structure is not motorized.

7. The card handling apparatus of claim 5, wherein the retractable support structure is motorized.

8. The card handling apparatus of claim 1, wherein the first shuffled deck of cards is transferred from the slot-less elevator to the retractable support structure by a downward movement of the slot-less elevator away from a plane that defines a discharge portal entrance.

9. The card handling apparatus of claim 1, wherein the first shuffled deck of cards is transferred from the slot-less elevator to the retractable support structure by an upward movement of the retractable support structure toward the plane that defines the discharge portal entrance.

10. The card handling apparatus of claim 1, wherein the retractable support structure comprises a pair of retractable support members.

11. The card handling apparatus of claim 1, wherein the retractable support structure is collapsible by the first shuffled deck of cards.

12. The card handling apparatus of claim 1, wherein the retractable support structure comprises at least one movable blade.

13. The card handling apparatus of claim 1, wherein the retractable support structure comprises at least one movable fork-shaped member.

14. The card handling apparatus of claim 1, wherein the slot-less elevator is fork-shaped.

15. The card handling apparatus of claim 1, wherein the randomizing chamber is devoid of compartments, card slots, combs, racks, carousels or ejector blades.

16. The card handling apparatus of claim 1, further comprising a randomizing mechanism comprising the gripper mechanism configured to grip and raise at least one individual card of the first individual deck of cards through an arc to create a wedge-shaped, position-tolerant opening between two stacks of the first shuffled deck of cards.

17. The card handling apparatus of claim 16, wherein the microcontroller utilizes a random number generator in real time for each and every card of the first individual deck of cards to determine a random separation level of the first individual deck of cards for receiving each card into the randomizing chamber.

18. The card handling apparatus of claim 1, wherein the microcontroller verifies a proper number of cards within the first individual deck of cards using the optical recognition sensor.

19. The card handling apparatus of claim 1, wherein the microcontroller verifies a rank and suit of each card of the first individual deck of cards using the optical recognition sensor.

20. The card handling apparatus of claim 1, wherein the control panel further comprises a means to alert a dealer that a faulty card deck has been prepared for future use.

21. The card handling apparatus of claim 1, wherein the control panel further comprises a display to alert a dealer to a verification status of a card deck that is being processed for future use.

22. The apparatus of claim 2 whereupon three separated card decks may coexist at discrete positions within the apparatus.

* * * * *